US007694637B2

(12) United States Patent
MacCallum et al.

(10) Patent No.: US 7,694,637 B2
(45) Date of Patent: Apr. 13, 2010

(54) METHOD AND APPARATUS FOR A SIMPLIFIED PRIMARY AIR SYSTEM FOR IMPROVING FLUID FLOW AND GAS MIXING IN RECOVERY BOILERS

(75) Inventors: Colin MacCallum, Nanaimo (CA); Brian Robin Blackwell, Vancouver (CA)

(73) Assignee: Boiler Island Air Systems Inc., West Vancouver (CA)

( * ) Notice: Subject to any disclaimer, the term of this patent is extended or adjusted under 35 U.S.C. 154(b) by 1092 days.

(21) Appl. No.: 10/554,976

(22) PCT Filed: May 17, 2004

(86) PCT No.: PCT/CA2004/000729

§ 371 (c)(1),
(2), (4) Date: Oct. 27, 2005

(87) PCT Pub. No.: WO2004/106808

PCT Pub. Date: Dec. 9, 2004

(65) Prior Publication Data

US 2007/0215023 A1 Sep. 20, 2007

(30) Foreign Application Priority Data

May 29, 2003 (CA) ..... 2429838

(51) Int. Cl.
*F23G 7/04* (2006.01)
*F23L 1/00* (2006.01)

(52) U.S. Cl. ..... 110/347; 110/348; 110/297; 110/343; 431/175

(58) Field of Classification Search ..... 110/347, 110/348, 297, 343; 431/175
See application file for complete search history.

(56) References Cited

U.S. PATENT DOCUMENTS

| | | | | |
|---|---|---|---|---|
| 5,121,700 | A | 6/1992 | Blackwell | |
| 5,305,698 | A * | 4/1994 | Blackwell et al. | 110/348 |
| 5,771,817 | A * | 6/1998 | Olausson et al. | 110/238 |
| 6,279,495 | B1 * | 8/2001 | Karidio et al. | 110/348 |
| 6,302,039 | B1 * | 10/2001 | MacCallum et al. | 110/348 |
| 7,185,594 | B2 * | 3/2007 | Higgins et al. | 110/238 |

FOREIGN PATENT DOCUMENTS

| | | |
|---|---|---|
| CA | 1308964 | 10/1992 |
| CA | 1324537 | 11/1993 |
| CA | 2245294 | * 3/2000 |

* cited by examiner

*Primary Examiner*—Steven B McAllister
*Assistant Examiner*—Nikhil Mashruwala

(57) ABSTRACT

This invention improves gas mixing and combustion, gaseous fluid flow and control of the char bed in recovery boilers burning black liquor or soda liquor, requires fewer primary air ports than conventional methods and can reduce capital and operating costs. Some primary air is introduced as powerful principal jets, from two opposing so-called active furnace walls. All or most of the remainder of the primary air is introduced as smaller jets, called scavenging jets, which prevent char from accumulating in the furnace corners and, in some cases, between the principal jets and are in the same plane as the principal jets. The momentum flux of each of the principal jets is approximately double or more than double that of each scavenging jet. Some of the primary air may be introduced as central jets, from the remaining two furnace walls and located in the same plane as the other ports, or on a second, somewhat higher plane. The momentum flux of the central jets is less than that of the principal jets.

49 Claims, 14 Drawing Sheets

Furnace - Plan View;
Method applied to typical boiler
with forced draft fan limitations;
Four sets of scavenging jets on each inactive wall;
Principal jets fully-opposed, but different sizes

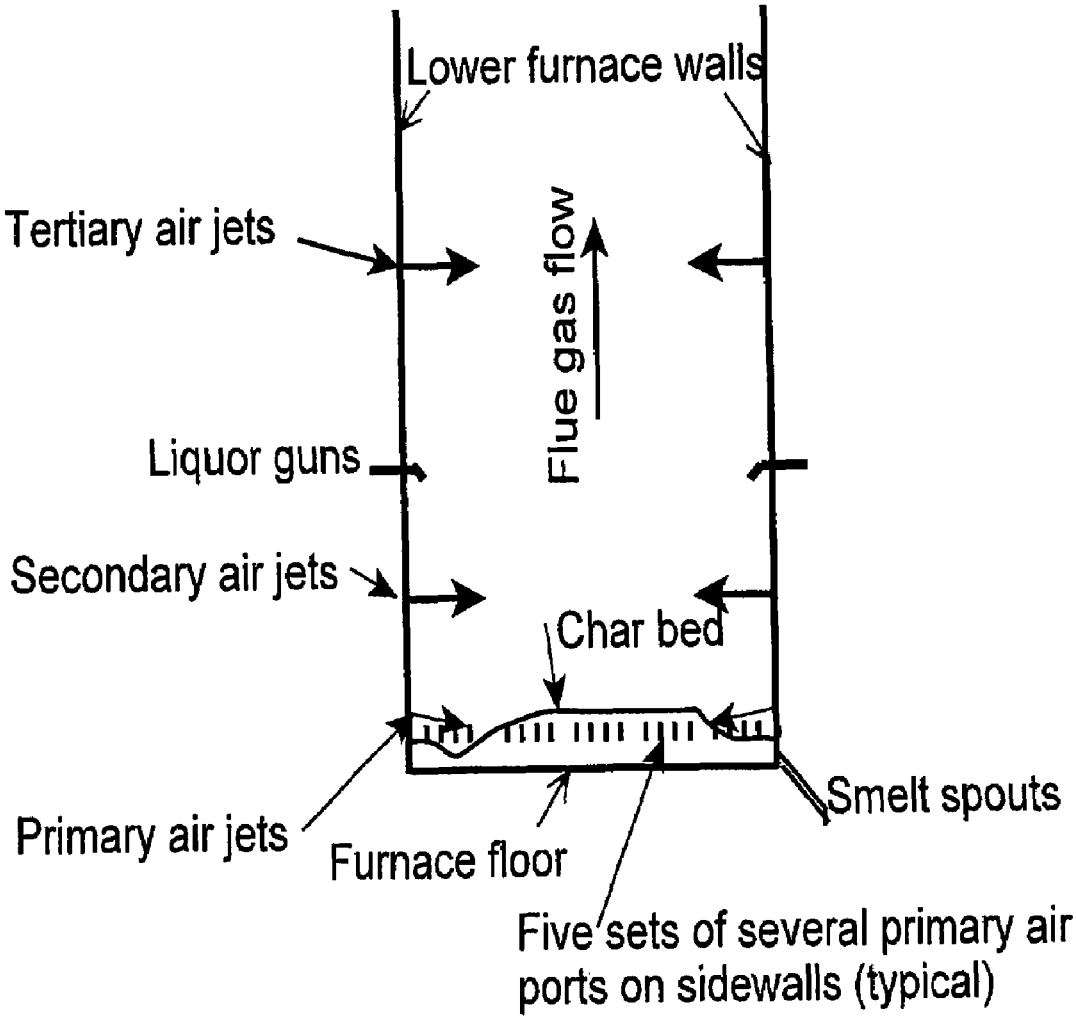
Fig.1 Typical flat-floor furnace - side view; Small primary air jets enter furnace at 0 to 5 degrees downwards on all four walls

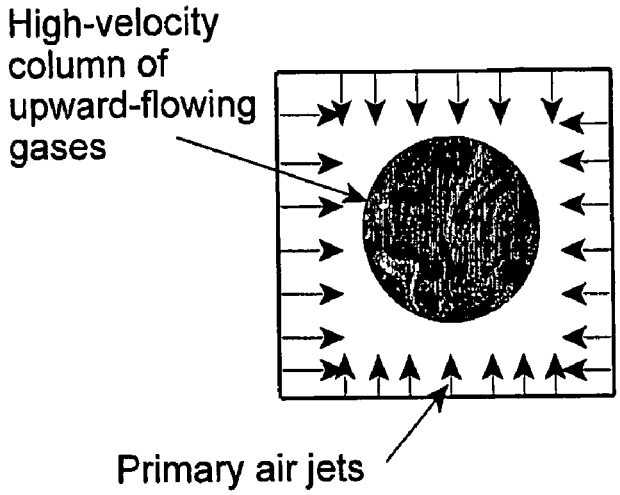
Fig.2 Furnace - Plan View; Four-wall primary air jets
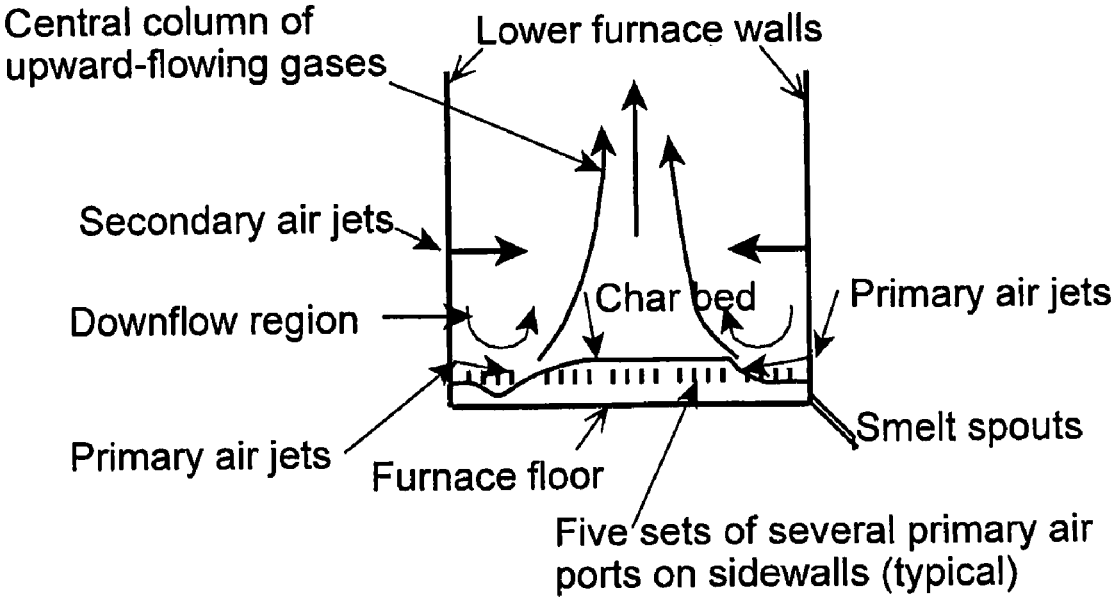
Fig.3 Flat-floor furnace - side view; Small primary air jets enter furnace at 0-5 degrees downwards on all four walls

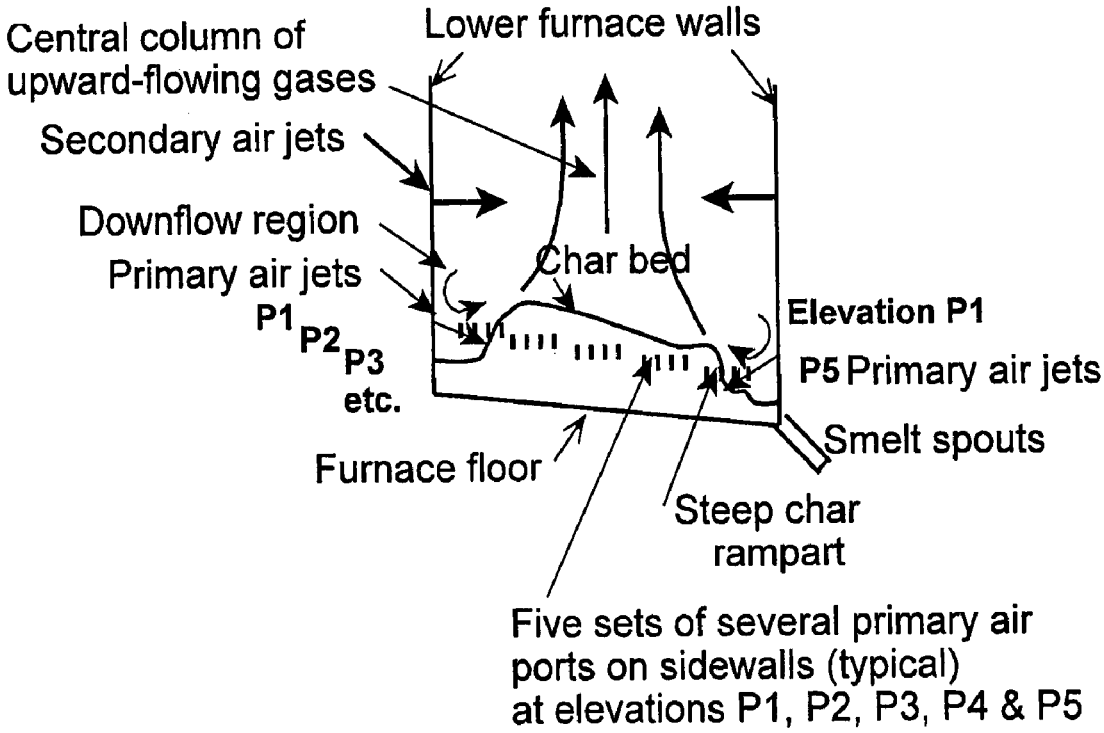
Fig.4 Sloping-floor furnace - side view;
Small primary air jets enter furnace
at about 30 degrees downwards on all four walls

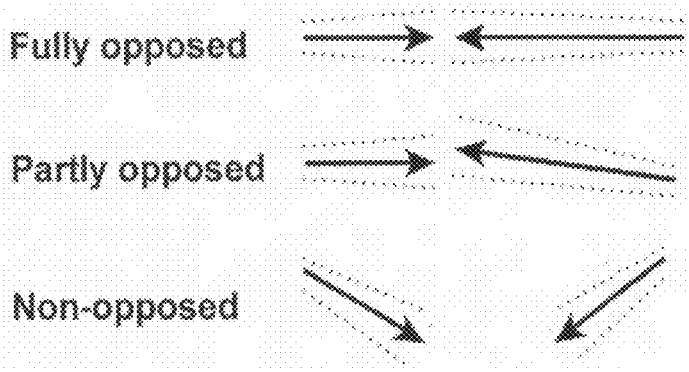
Fig.5 Juxtaposition of fully-opposed, partly-opposed and non-opposed jets
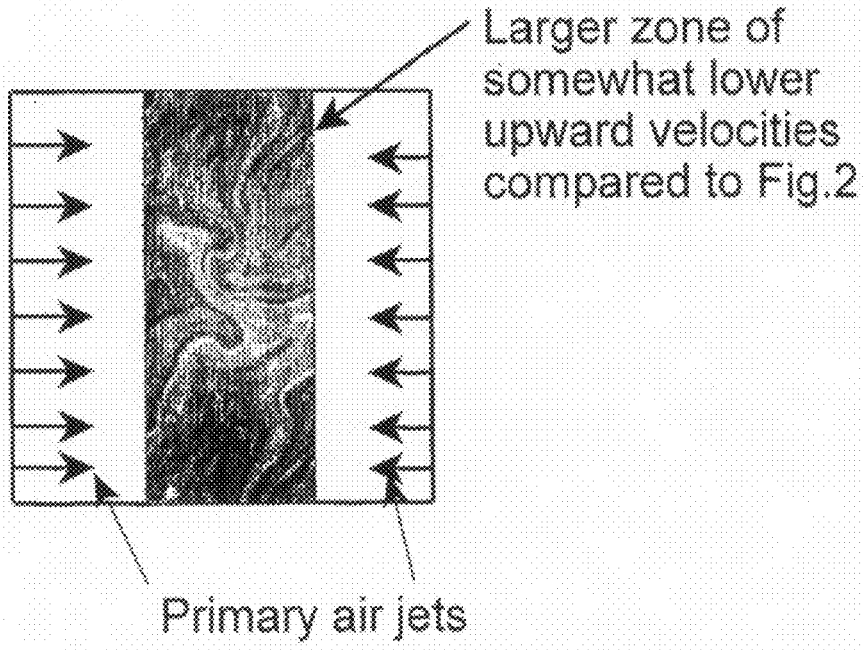
Fig.6 Furnace - Plan View; Two-wall primary air jets

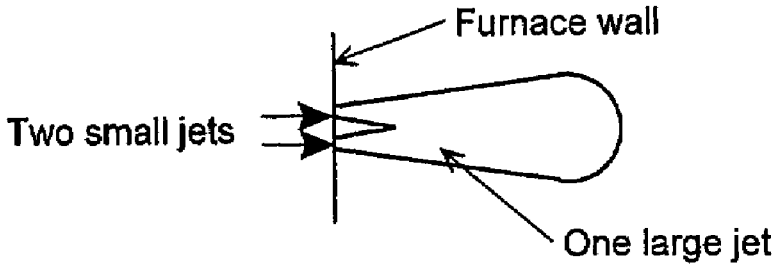
Fig.7 Schematic plan or elevation of register effect, namely, two or more air jets combining to form a single large jet
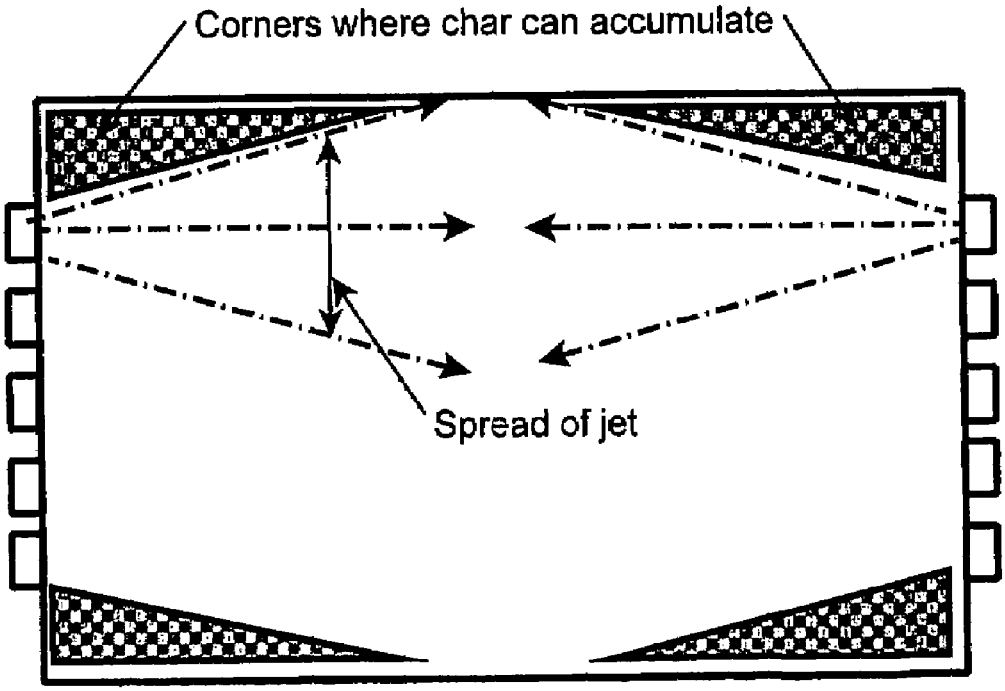
Fig.8 Furnace - Plan View; Furnace corners where char accumulates if no scavenging jets are provided

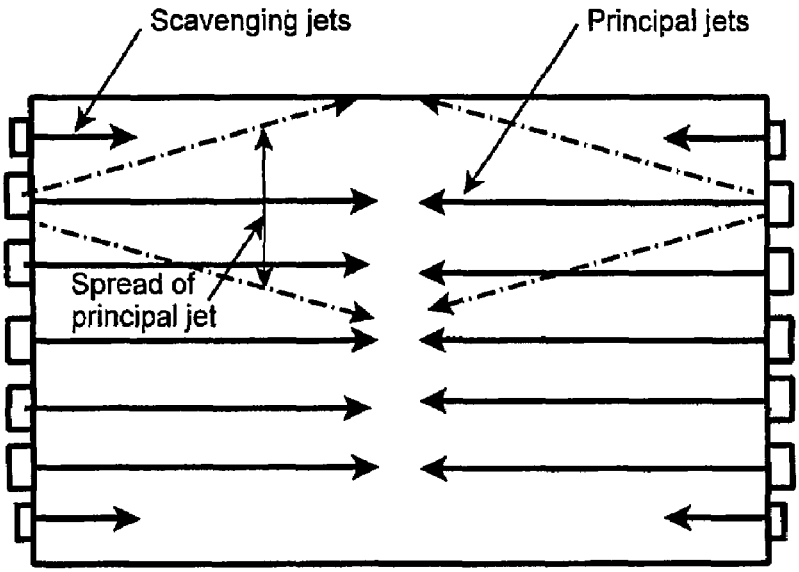
Fig.9 Furnace - Plan View;
Equal-sized fully-opposed principal jets
with scavenging jets on same walls
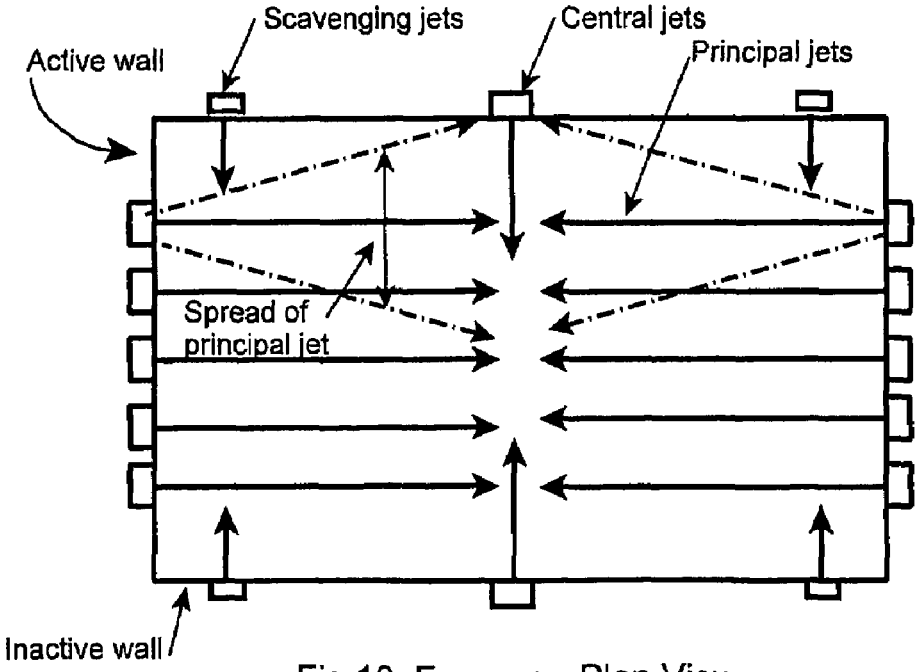
Fig.10 Furnace - Plan View;
Scavenging jets and central jets on inactive walls

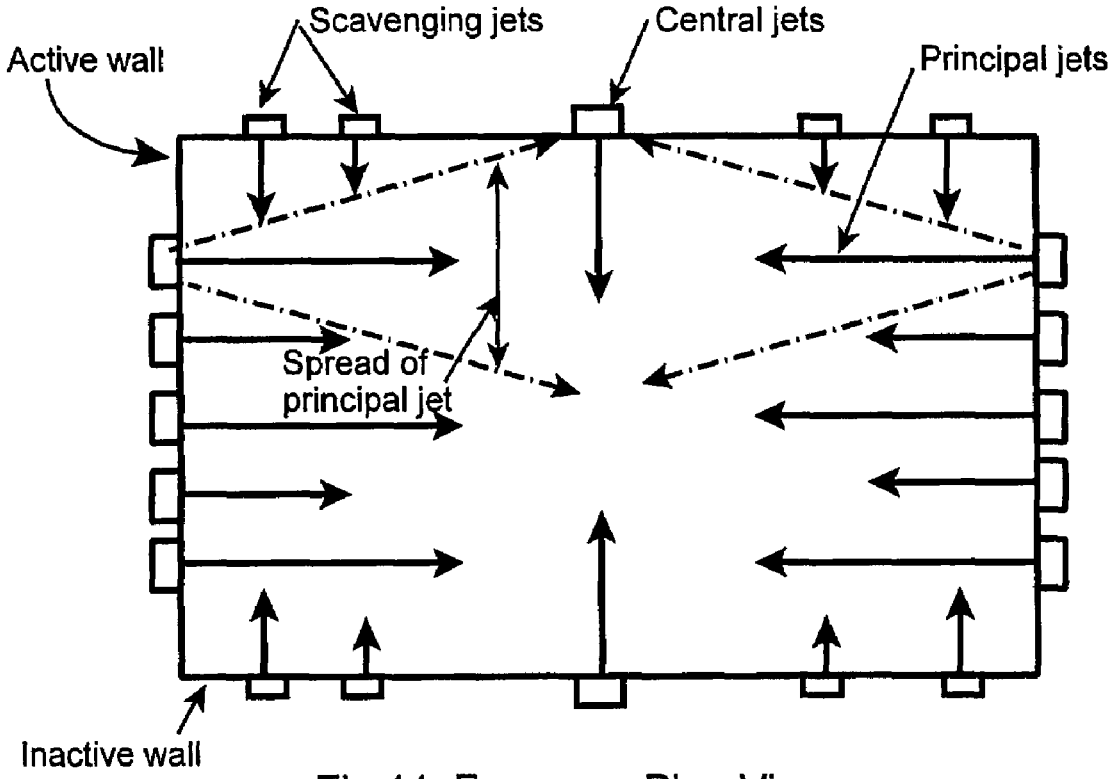
Fig.11 Furnace - Plan View;
Method applied to typical boiler
with forced draft fan limitations;
Four sets of scavenging jets on each inactive wall;
Principal jets fully-opposed, but different sizes

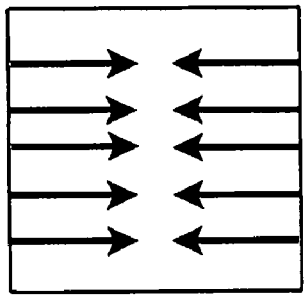
Fig.12 Furnace - Plan View;
Fully-opposed, balanced air jets
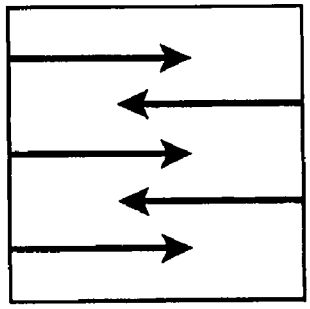
Fig.13a Furnace - Plan View;
Symmetrical, balanced,
fully-interlaced air jets
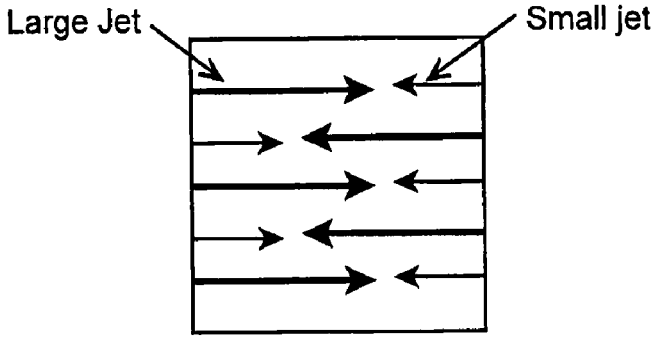
Fig.13b Furnace - Plan View;
Symmetrical, balanced,
partially-interlaced air jets

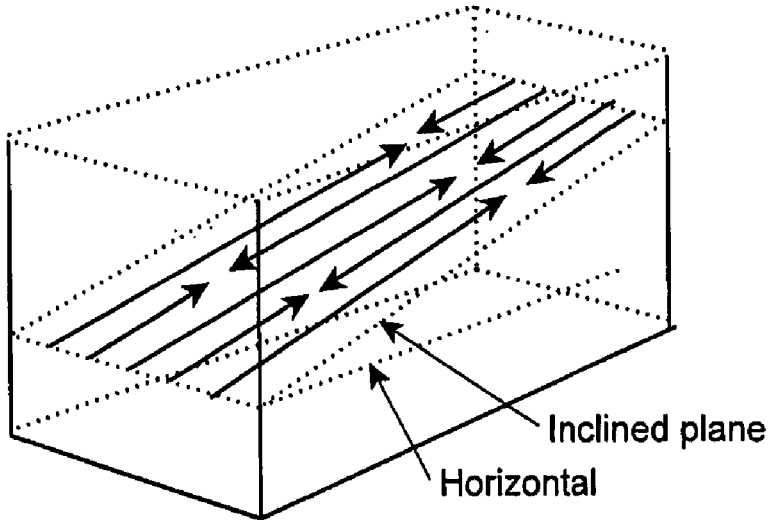

Fig.14 Lower Furnace; 3-dimensional; Balanced partially-interlaced principal jets in flat, inclined plane, with jet direction parallel to the direction of the incline; Scavenging jets not shown

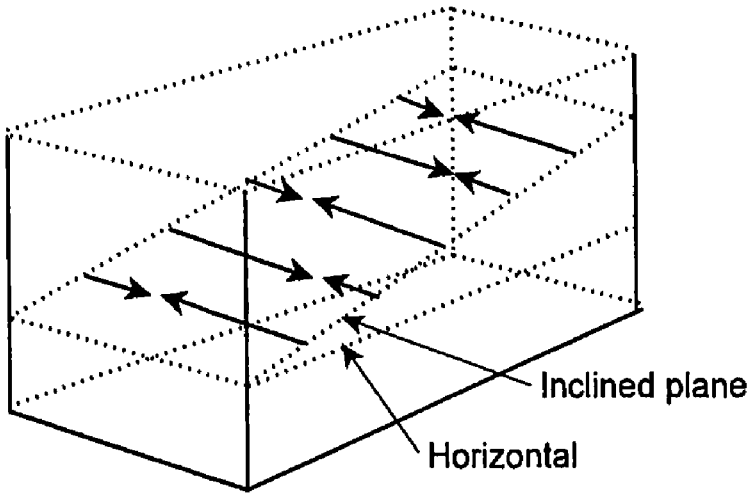

Fig.15 Lower Furnace; 3-dimensional; Balanced partially-interlaced principal jets in flat, inclined plane, with jet direction at right angles to the direction of the incline; Scavenging jets not shown

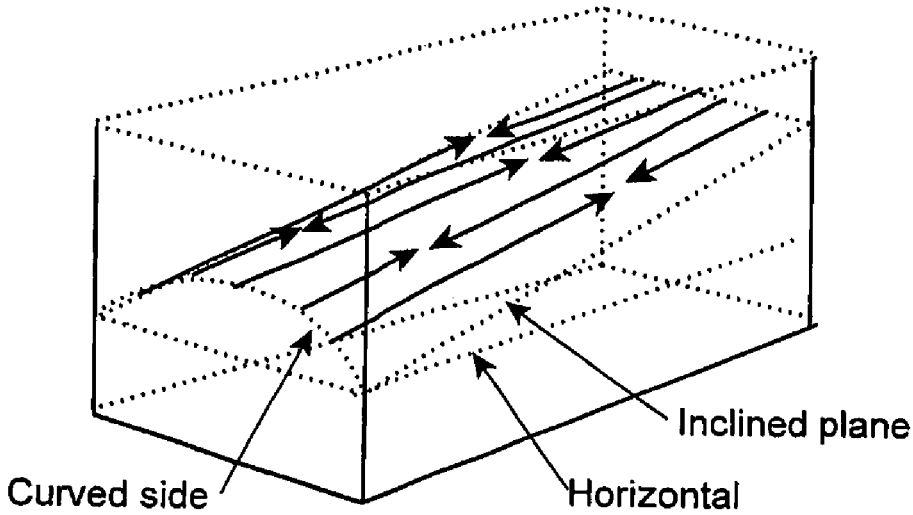

Fig.16 Lower Furnace; 3-dimensional; Balanced partially-interlaced principal jets in inclined plane with one curved side, with jet direction parallel to incline; Scavenging jets not shown

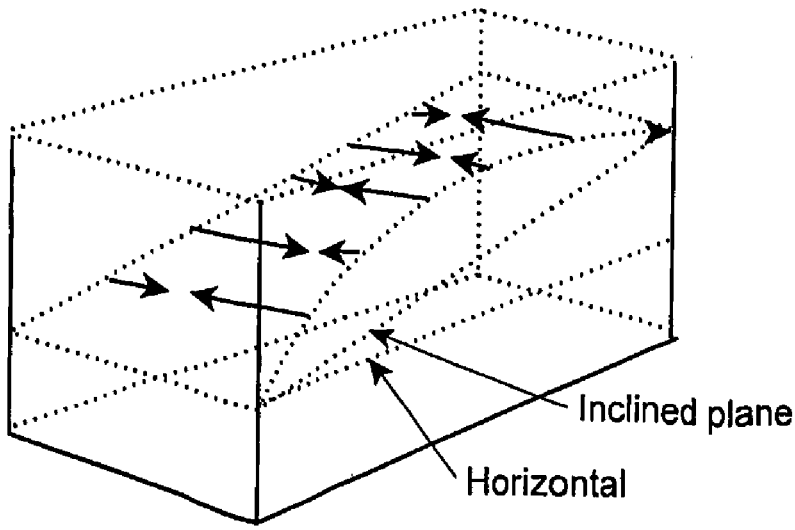

Fig.17 Lower Furnace; 3-dimensional; Balanced partially-interlaced principal jets in inclined plane with one curved side with jet direction at right angles to incline; Scavenging jets not shown

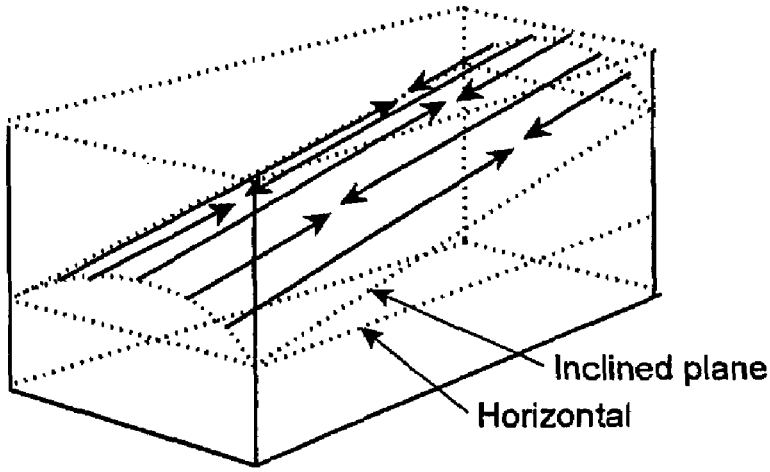

Fig.18 Lower Furnace; 3-dimensional; Balanced partially-interlaced principal jets in inclined plane with two curved sides, with jet direction parallel to incline; Scavenging jets not shown

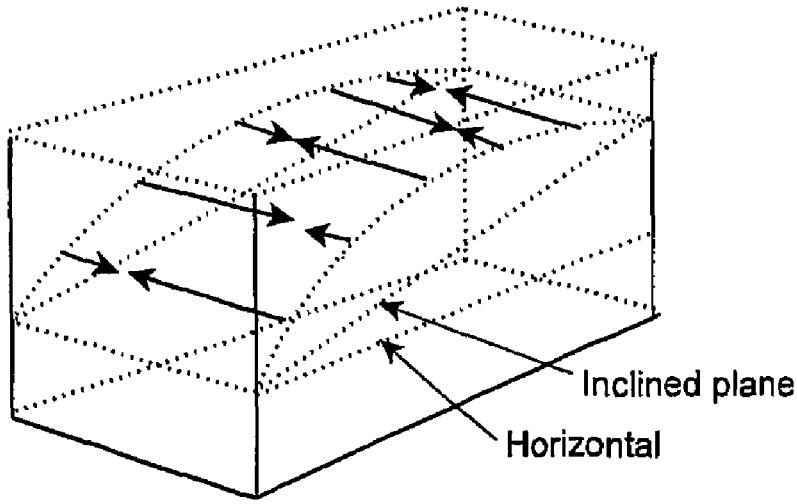

Fig.19 Lower Furnace; 3-dimensional; Balanced partially-interlaced principal jets in inclined plane with two curved sides, with jet direction at right angles to incline; Scavenging jets not shown

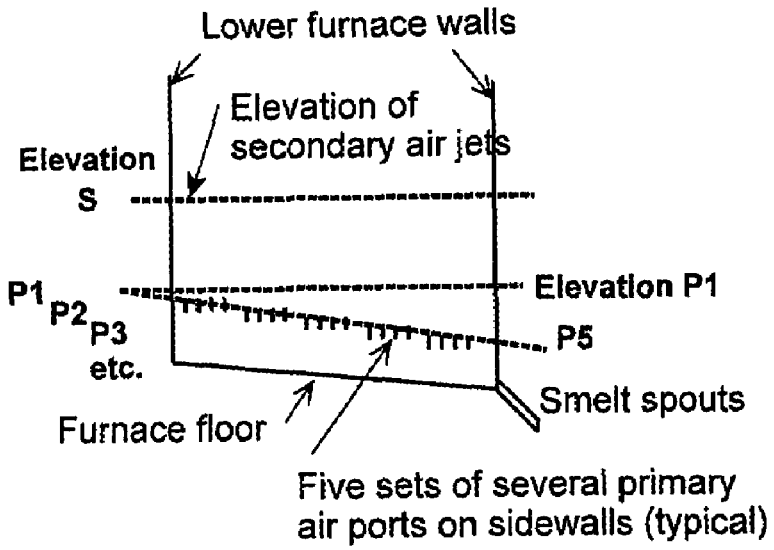
Fig.20 Sloping-floor furnace - side view; showing Horizontal Plane P1-P1 and Proposed Plane P1-P5 for two-wall primary air principal jets from front & rear walls or, alternatively, from sidewalls
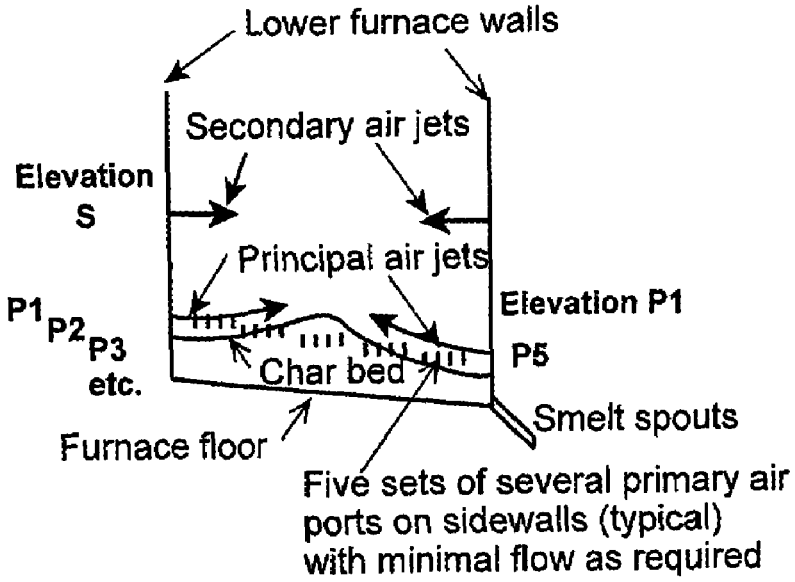
Fig.21 Sloping-floor furnace - side view; Proposed two-wall primary air principal jets from front & rear walls at Plane P1-P5

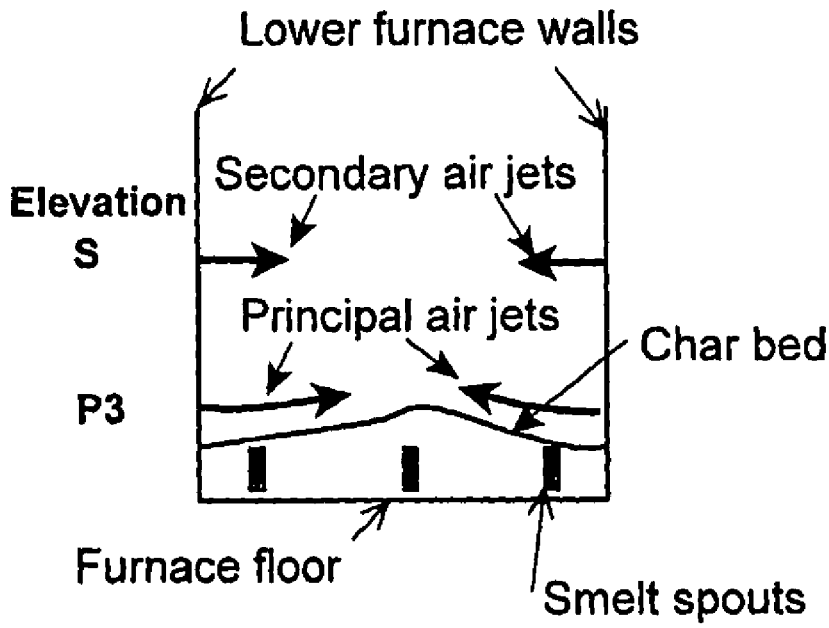
Fig.22 Sloping-floor furnace - front view; Proposed two-wall primary air principal jets from sidewalls (only P3 jets shown); Scavenging jets not shown

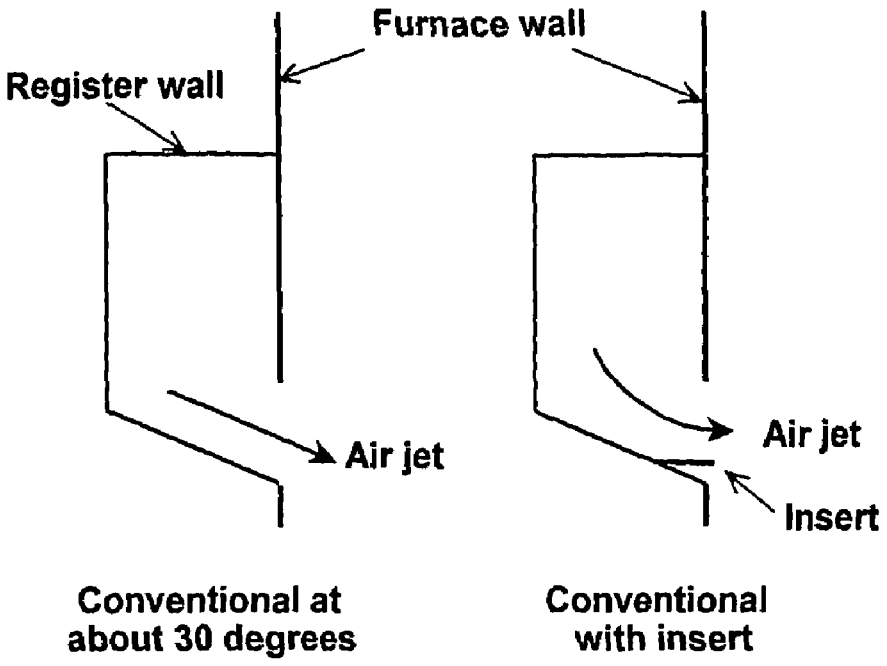
Fig.23 Sectional view of downward-sloping-port registers; Conventional at about 30 degrees downward and with insert to give horizontal jet
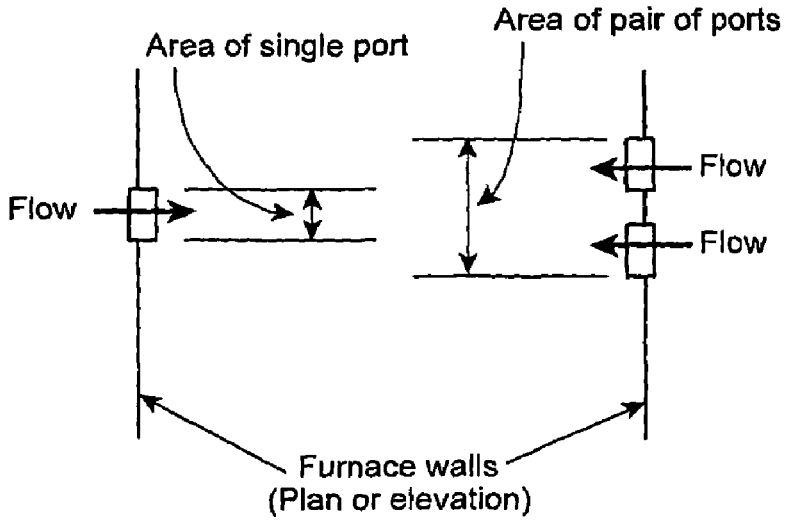
Fig.24 Lower Furnace, Part View Schematic; All of the area of a single port opposite the area of a pair of ports

METHOD AND APPARATUS FOR A SIMPLIFIED PRIMARY AIR SYSTEM FOR IMPROVING FLUID FLOW AND GAS MIXING IN RECOVERY BOILERS

FIELD OF THE INVENTION

The recovery boilers to which the invention applies burn liquor from various pulping processes which are employed in the manufacture of pulp and paper. These processes include: the kraft process, the soda process, the sodium-based sulphite process and the closed-cycle CTMP (chemical, thermal, mechanical pulp) process. The boilers generate steam for various process requirements.

The boilers require combustion air and generally have furnaces which are rectangular in horizontal cross-section. All the combustion air is introduced through multiple air ports in the furnace walls.

The air ports are arranged in several zones, or sub-systems of ports, named, successively, from the furnace floor elevation, upwards: primary air, secondary air and tertiary air, etc. The ports of each air zone may be on one or more walls of the furnace. In a conventional furnace, the primary air ports are on all four walls.

This invention is directed to a method and apparatus for an effective, simplified, potentially two-wall primary air system including principal jets, scavenging jets and central jets for improving combustion and the operation of the recovery boiler. The adoption of the proposed method and apparatus can be expected to reduce capital and operating costs.

The method can be applied to new, or retrofitted, or existing boilers.

PRIOR ART

The recovery boilers to which the proposed invention applies all have primary air systems, generally on four walls of a rectangular furnace.

The proposed invention will simplify the primary air system by eliminating or by reducing the number of air ports on two of the opposing furnace walls and, at the same time, will improve the operation of the boiler.

By way of exemplification and not limitation, several examples of prior art forms of two-wall primary air-jet arrangements and of partially-interlaced air-jet arrangements are described in the following paragraphs. The concepts embodied in the proposed invention employ components of these prior art forms but the additional unique features of the proposed method are the small scavenging jets in the corners of the furnace and, where applicable, the central jets from the inactive walls.

The principle of the two-wall primary-air jet arrangement was suggested in 1994 by the inventors and implemented as an improvement to a boiler which originally started up in 1955 at Tasman Pulp and Paper Limited, in New Zealand. After some three years of operation with the primary air shut off from two opposing walls, the boiler was rebuilt with a two-wall arrangement. With the two-wall primary-air mode of operation, the TRS emissions were significantly lower than they were with the original four-wall mode of operation and the reduction efficiency was significantly higher. The furnace had a horizontal floor and all the primary air ports were at the same elevation. The primary air ports were angled downwards at 25 degrees, so the powerful air jets from the two opposite walls were not horizontal, not fully opposed or partly opposed, nor parallel to the floor. The concept of principal jets, scavenging jets and central jets was not employed. The boiler was taken out of service in early 2000.

Two patents, entitled "Method and apparatus for improving fluid flow and gas mixing in boilers", describe a method and apparatus also invented by Blackwell and MacCallum, wherein the primary air in a recovery boiler is introduced substantially from two walls, with a small portion of the total primary air introduced from the other two walls:

Canadian Patent No. 1,324,537; Serial No. 616,260; Issue date 23 Nov. 1993

U.S. Pat. No. 5,305,698: Issue date 26 Apr. 1994.

The broadest method claims of these patents have a set of large jets on each of two opposing walls (the first and second walls) of a furnace and a set of small jets on each of the other two opposing walls, the third and fourth walls. The broadest apparatus claims have a set of similarly-sized ports on all four walls and dampers to create a set of small jets on each of the two, third and fourth walls.

The proposed invention employs large, so-called principal jets, small scavenging jets and central jets which are smaller than the principal jets and the same size as, or larger than the scavenging jets. There can be different sizes of scavenging jets. The inventions of the small scavenging jets and of the central jets, whose purposes are explained in the disclosure below, are unique features of the proposed invention.

Thus, in the invention, the jets on each wall are not necessarily the same size, in which case the above two patents do not constitute prior art.

Also in the invention, where the jets on the third and fourth walls are the same size, they are arranged in several specific manners which are critical to the functioning of the invention. As a result of these specific arrangements, the above two patents again do not constitute prior art.

There are two patents which claim the invention by Blackwell and MacCallum of partially-interlaced air jets:

Canadian Patent No. 1,308,964: Serial No. 564,320; Issue date 20 Oct. 1992, also entitled "Method and apparatus for improving fluid flow and gas mixing in boilers", wherein the partially-interlaced air jets are in a horizontal plane U.S. Pat. No. 6,302,039 B1: Issue date, 16 Oct. 2001, entitled "Method and apparatus for further improving fluid flow and gas mixing in boilers", wherein the partially-interlaced air jets are in a non-horizontal plane.

The proposed invention adds scavenging jets and, in certain instances, central jets, to a partially-interlaced arrangement of principal jets which can be a component of all four embodiments of the invention. The addition of these scavenging jets, with or without the addition of central jets, is unique and thus these two patents do not constitute prior art.

Another U.S. Pat. No. 5,121,700: Issue date 16 Jun. 1992, also entitled "Method and apparatus for improving fluid flow and gas mixing in boilers", describes a method and apparatus wherein combustion air is introduced in a partially-interlaced manner. Where the partially-interlaced jets are at elevations above the primary air elevation, the patent adds a two-wall primary air component which is not a stand-alone invention. This patent does not constitute prior art because the proposed invention has scavenging jets and central jets and because the primary air system in the proposed invention is completely independent of the air systems above the primary elevation. In the proposed invention, the arrangement of the secondary air-jets is irrelevant to the arrangement of the primary air jets.

Canadian Patent Application No. 2,245,294, Filing date Sep. 04, 1998 by MacCallum and Blackwell contains elements of the proposed invention. Again, this patent application does not constitute prior art because it does not have the scavenging jets and central jets of the proposed invention.

The following paragraphs discuss the embodiments of the proposed invention.

In the first embodiment of the proposed invention, at least one small scavenging jet is located at each end of each of the same walls as the principal jets, in the same plane as the principal jets, so there are large and small jets on the same walls, unlike the above patents relating to two-wall primary air, namely Canadian Patent No. 1,324,537 and U.S. Pat. No. 5,305,698.

In the second embodiment of the proposed invention, the small jets on the third and fourth sides (the "inactive" walls) are arranged in a specific manner, namely arranged as scavenging jets at the ends of the inactive walls, in the same plane as the principal jets (the "principal-jet plane"), with no other jets on the inactive walls.

In the third embodiment of the proposed invention, at least one scavenging jet is located at each end of each of the same walls as the principal jets, in the same plane as the principal jets, with additional small, so-called "central jets" on the inactive walls; these central jets are located either in the principal-jet plane, or in a plane above the principal-jet plane. The central jets can be larger than the scavenging jets.

In the fourth embodiment of the proposed invention, there are small scavenging jets at the ends of the inactive walls, with the central jets on the same walls, either in the same plane, or in a plane above the principal plane.

The proposed method and apparatus are improvements on, and extensions to the above-mentioned patents.

SUMMARY OF THE INVENTION

Improved combustion and minimal entrainment of liquor-spray particles and char particles in the flue gases of a recovery furnace firing liquor from the kraft process, the soda process, the sodium-based sulphite process, and the closed-cycle CTMP process, can be achieved with the method and apparatus of the invention, which is an effective, simplified primary air system for reducing capital and operating costs, for improving combustion and for improving the operation of the recovery boiler.

The method comprises introducing some of the primary air as one or more fully-opposed, or partly-opposed, or partially-interlaced, or fully-interlaced jets, hereinafter called "principal jets", from two opposing furnace walls, hereinafter called the "active" walls. The ports from which the principal jets issue are all in the same plane, hereinafter called the "principal-jet plane". The primary air introduced through the active walls can be distributed more or less equally from each of the active walls. The primary air quantity introduced through one active wall can be greater than the quantity introduced through the opposite wall.

The fully-opposed or partly-opposed or fully-interlaced principal jets can be of essentially equal size, or they can be of different sizes. A partially-interlaced pattern comprises large and small air jets, each large jet being fully opposed or partly opposed by a small jet originating from the opposite wall. The large and small jets alternate on each wall; i.e. they are arranged small/large/small/large, etc. across the width, or depth of the furnace. The pattern may be symmetrical in the principal-jet plane, but need not be symmetrical. The partially-interlaced pattern may be balanced, or unbalanced, as explained later.

In a first embodiment of the invention, the remainder of the primary air is introduced as at least four smaller jets, hereinafter called scavenging jets, each located at opposite ends of each of the two active walls such that all the principal jets on each active wall are located between the scavenging jets on the same wall and all the ports from which all the jets originate are located on the sides of a common plane, the principal-jet plane, which is horizontal or inclined. Additional scavenging jets can be located between the principal jets.

For the purposes of this discussion, the momentum flux of an air jet is defined as the product of the jet's initial velocity and its mass flow. In the invention, the momentum flux of the large principal jets is approximately double or more than double that of the scavenging jets.

In the first embodiment of the invention, there are no ports on the two remaining sides of the plane, hereinafter called the "inactive" sides of the principal-jet plane.

In a second embodiment of the invention, the scavenging jets are located on opposite ends of each of the two inactive walls and all the ports from which all the jets originate are located on the sides of the principal-jet plane, which may be horizontal or inclined. Additional scavenging jets can be located between the principal jets.

In a third embodiment of the invention, some of the remainder of the primary air is introduced as scavenging jets from the active walls, as in the first embodiment. The remainder of the primary air is introduced from the two inactive walls in other jets, hereinafter called "central jets".

The momentum flux of the central jets is less than that of the principal jets.

In a fourth embodiment of the invention, all the remainder of the primary air is introduced from the inactive walls as scavenging jets and central jets, such that scavenging jets are located at the opposite ends of the inactive walls, and the central jets are located between the two sets of scavenging jets on each inactive wall. Additional scavenging jets can be located between the principal jets.

In all four embodiments, the ports from which the scavenging jets originate are located on the sides of the principal-jet plane. On the other hand, the central-jet ports may be located on the sides of the same plane as the other ports, but can be located on the sides of a second plane which is above, and may be parallel to, the principal-jet plane.

The central jets can be, but need not be, located in the centre of the inactive walls. The central-jet ports on one wall can be, but need not be, opposite the central-jet ports on the opposite wall.

The primary air introduced through the inactive walls can be distributed more or less equally from each of the inactive walls. The primary air quantity introduced through one inactive wall can be greater than the quantity introduced through the opposite wall.

One or more sides of the planes can be flat, or curved. The planes can be inclined in the direction of the jet flow, inclined at right angles to the direction of the jet flow (that is, the jet direction is at right angles to the incline), skewed, or essentially parallel to the floor in a sloping-floor furnace.

The principal jets from the active walls are directed more or less in the plane, or slightly downwards relative to the plane, or slightly upwards, while the scavenging air jets and the central jets are steeply sloping downwards relative to the plane, or directed more or less in the plane, or slightly downwards, or slightly upwards relative to the plane, or planes, as applicable.

DESCRIPTION OF THE DRAWINGS

The following drawings illustrate specific embodiments of the invention, but should not be construed as restricting the spirit or scope of the invention in any way:

FIG. 1 is a schematic sectional side elevation of the lower portion of a typical recovery furnace with a flat floor and indicates the location of the liquor guns, the char bed and the combustion air elevations including the primary air ports which are directed at 0 to 5 degrees downwards from the horizontal on all four walls.

FIG. 2 is a schematic cross-sectional plan view of a typical furnace showing the primary air jets being admitted from all four walls and also showing the cross-sectional area occupied by the central column of upward-flowing gases.

FIG. 3 is a schematic sectional side elevation of the lower portion of a typical "flat-floor" furnace, that is, a recovery furnace with a horizontal floor, and indicates the location of the primary air jets which are directed at 0 to 5 degrees downwards from the horizontal on all four walls. The typical profile of the char bed is indicated. Further, the central chimney of rapidly-upward-flowing gases, and the regions of down-flowing gases associated with the primary air jets, are illustrated.

FIG. 4 is a schematic sectional side elevation of the lower portion of a typical recovery furnace with a sloping floor and indicates the location of the primary air jets which are directed at approximately 30 degrees downwards from the horizontal on all four walls. The typical profile of the char bed with its steep char rampart is indicated. The various typical elevations of the various air registers on the sidewalls are shown. Further, the central chimney of rapidly-upward-flowing gases, and the regions of down-flowing gases associated with the primary air jets, are illustrated.

FIG. 5 shows the juxtaposition, for example in plan view or elevation, of pairs of air jets that are fully opposed, partly opposed, and non-opposed.

FIG. 6 is a schematic cross-sectional plan view of a typical recovery furnace and indicates the location of the rectangular region of upward-flowing gases created by a two-wall primary air arrangement with equally-sized air jets from two walls only.

FIG. 7 is a schematic plan view or elevation of the register effect, indicating the combination of two jets from a pair of ports to form a single larger jet.

FIG. 8 is a schematic cross-sectional plan view of a typical recovery furnace with large principal jets from the two active walls and indicates the regions in the corners, where char can accumulate if no scavenging jets are provided. For simplicity, only two opposing jets are shown.

FIG. 9 is a schematic cross-sectional plan view of a typical recovery furnace with two-wall primary air with equally-sized fully-opposed principal jets, with scavenging jets in the corners on the same walls as the principal jets, as in one version of the first embodiment.

FIG. 10 is a schematic cross-sectional plan view of a typical recovery furnace with two-wall primary air with equally-sized fully-opposed principal jets, with scavenging jets on the inactive walls. Some central jets on the inactive walls are also shown, in this instance at the centre of the inactive walls, as in the fourth embodiment.

FIG. 11 is a schematic cross-sectional plan view of a typical furnace showing the method applied to a typical existing boiler with fan limitations. The principal jets are fully-opposed, but of different sizes and, on each inactive wall, there are four sets of scavenging jets and one set of central jets, shown here at the centre of each inactive wall, as in the fourth embodiment.

FIG. 12 is a schematic cross-sectional plan view of a typical furnace showing fully-opposed air jets being admitted from any two opposing walls.

FIG. 13*a* is a schematic cross-sectional plan view of a typical furnace showing a symmetrical arrangement of balanced fully-interlaced air jets being admitted from any two opposing walls.

FIG. 13*b* is a schematic cross-sectional plan view of a typical furnace showing a symmetrical arrangement of balanced partially-interlaced air jets being admitted from any two opposing walls.

FIG. 14 is a schematic three-dimensional view of the lower portion of a typical furnace showing a symmetrical arrangement of balanced partially-interlaced principal air jets in a flat, inclined plane, the jets being admitted from two opposing walls, with the jet direction parallel to the direction of the incline of the plane. The scavenging jets are not shown.

FIG. 15 is a schematic three-dimensional view of the lower portion of a typical furnace showing a symmetrical arrangement of balanced partially-interlaced principal air jets in a flat, inclined plane, the jets being admitted from two opposing walls, with the jet direction at right angles to the direction of the incline of the plane. The scavenging jets are not shown.

FIG. 16 is a schematic three-dimensional view of the lower portion of a typical furnace showing a symmetrical arrangement of balanced partially-interlaced principal air jets in an inclined plane having one curved side, the jets being admitted from two opposing walls, with the jet direction parallel to the direction of the incline of the plane. The scavenging jets are not shown.

FIG. 17 is a schematic three-dimensional view of the lower portion of a typical furnace showing a symmetrical arrangement of balanced partially-interlaced principal air jets in an inclined plane having one curved side, the jets being admitted from two opposing walls, with the jet direction at right angles to the direction of the incline of the plane. The scavenging jets are not shown.

FIG. 18 is a schematic three-dimensional view of the lower portion of a typical furnace showing a symmetrical arrangement of balanced partially-interlaced principal air jets in an inclined plane having two curved sides, the jets being admitted from two opposing walls, with the jet direction parallel to the direction of the incline of the plane. The scavenging jets are not shown.

FIG. 19 is a schematic three-dimensional view of the lower portion of a typical furnace showing a symmetrical arrangement of balanced partially-interlaced principal air jets in an inclined plane having two curved sides, the jets being admitted from two opposing walls, with the jet direction at right angles to the direction of the incline of the plane. The scavenging jets are not shown.

FIG. 20 is a schematic sectional side elevation of the lower portion of a typical recovery furnace with a sloping floor and indicates the horizontal plane P1-P1. It also shows the Plane P1-P5, from the sides of which the large principal air jets would be directed in the proposed method, in one manner, from the wall opposite the spout wall at elevation P1 and from the spout wall at elevation P5; or alternatively, in another manner, from the sidewall registers at elevations P1, P2, P3, etc., along the sides of the plane P1-P5.

FIG. 21 is a schematic sectional side elevation of the lower portion of a typical recovery furnace with a sloping floor and indicates the large principal air jets proposed in the method, directed from the wall opposite the spout wall (the rear wall) at elevation P1 and from the spout wall (the front wall) at elevation P5. The sculpted profile of the char bed with its central ridge, typical of two-wall primary air operation in boilers smaller than about 9 m square, is indicated. The scavenging jets are not shown.

FIG. 22 is a schematic sectional elevation of the lower portion of a typical recovery furnace with a sloping floor, where the section is taken through both sidewall registers at Elevation P3, looking towards the smelt-spout wall. The diagram indicates the large principal air jets proposed in the method, directed from the sidewall registers at elevation P3. Neither the corresponding principal jets from the other sidewall registers nor the scavenging jets are shown. The location of the smelt spouts on the front (or rear) wall is indicated. The sculpted profile of the char bed with its central ridge, typical of two-wall primary air operation in boilers smaller than about 9 m square, is indicated.

FIG. 23 is a schematic sectional side elevation of a typical port register in a recovery furnace with a sloping floor, indicating, on the left of the figure, the conventional design with the air jet issuing at approximately 30 degrees downwards from the horizontal and, on the right of the figure, the same register with an insert at the port opening to deflect the jet towards the horizontal.

FIG. 24 is a schematic part view of the lower portion of two opposing walls of a typical furnace, in plan or in elevation, showing a single port in one wall and a pair of ports in the opposite wall, with all of the area of the single port opposite the area of the pair of ports.

DETAILED DESCRIPTION OF THE INVENTION

Boilers are widely used to generate steam for numerous applications. All boilers which burn fuel (other than nuclear fuel) require combustion air. The combustion air is introduced into the furnace and, because the mixing of the combustion air and the fuel is imperfect, an air quantity in excess of the theoretical amount is required. The combustion air quantity which is employed in excess of the theoretical amount of air is called "excess air". The theoretical combustion air and the excess air are admitted to the boiler system at ambient temperature. The excess air is heated up in the boiler and is exhausted to atmosphere with the other flue gases, at the temperature of the flue gases leaving the stack. Excess air thus absorbs otherwise-useful heat and reduces the thermal efficiency of boilers. One of the advantages of the proposed method is that the mixing of combustion air and combustibles in the furnace is improved and thus the excess air quantity may be reduced, so the thermal efficiency of the boiler is increased.

Generally, the walls and the floor of the furnaces in modern boilers consist of water-cooled tubes. Adjacent furnace tubes are fully-welded together along their lengths to form a gas-tight envelope which contains the furnace gases.

In the pulp and paper industry, recovery boilers are used to burn the waste liquor produced in a pulp-making process. The waste liquor is called black liquor in the kraft process, in the soda process, in the sodium-based sulphite process and in the CTMP process. In the soda process, the liquor may also be called soda liquor.

The liquor from these pulping processes consists of a mixture of the spent chemicals from the pulping processes, and water; some of the spent chemicals are dissolved, but some are present in colloidal and particulate form.

Black Liquor Recovery Boilers

In burning black liquor, the boilers dispose of the liquor and, in most cases, the inorganic materials resulting from the combustion are recovered to regenerate the pulping chemicals. A prime function of a recovery boiler is to convert oxidised sulphur compounds such as, $Na_2SO_4$, $Na_2SO_3$, and $Na_2S_2O_3$, to the reduced form $Na_2S$, which is an active component of the so-called white liquor which is used in the pulping process. The reduction efficiency of a recovery boiler is a measure of its ability to convert these oxidised sulphur compounds to $Na_2S$.

Recovery boilers generally have furnaces which are rectangular in horizontal cross-section and tall. The furnace height, from furnace floor to furnace roof, may be 10 to 50 or 55 m, depending on the capacity of the boiler. The furnace walls may be 5 to 15 m wide.

All these boilers require combustion air, all of which is introduced through multiple air ports located in the furnace walls.

The liquor is introduced, without atomization, through one or more liquor nozzles, or liquor guns, which are inserted through openings in the walls of the furnace, generally at a common elevation some 4 to 7 m above the furnace floor. Where multiple liquor guns are employed, they are distributed around the periphery of the furnace.

In the soda process, steam or air is employed to disperse the liquor spray. The term "atomization" is popularly used to describe the process of liquor dispersion into the furnace.

Auxiliary burners firing oil or natural gas are provided for start-up or low-load conditions or when the combustion of the liquor is difficult for some reason. There are usually four of these burners, each burner generally located in, or close to, the corners of the furnace, about 0.5 to 1 m above the primary air ports.

When the black liquor is sprayed into the hot furnace, some in-flight drying of the liquor-spray particles occurs, and some of the volatile combustible components vaporize. Most or all of these volatiles burn in the furnace.

Large, heavy, liquor-spray particles that are too large to be carried out of the furnace by the up-flowing gases, fall to the bottom of the furnace and form a char bed or are deposited on the lower furnace walls and, at some point, fall on to the char bed where the combustion reactions continue. When the liquor-spray particles in, or on, the char bed, or on the walls, or liquor-spray particles in flight, are sufficiently dry, they pyrolize and burn, thereby forming combustion gases and releasing and/or forming other chemicals, some of which are carried upwards, as chemical fumes, by the combustion gases.

Some of the lighter liquor-spray particles are entrained by the flue gases and are carried upwards into the upper regions of the boiler where the pendent heating surfaces, such as the superheater, generating bank and economizer, are located.

Molten smelt, together with imperfectly combusted solid materials including carbon char particles and unburned liquor, percolates through the char bed. In cases where the black-liquor-spray particles are sprayed on to the walls, the resulting smelt also runs down the walls of the furnace. The molten smelt is extremely corrosive; therefore, the walls of the lower furnace, from the floor upwards, sometimes as high as the tertiary air ports which are generally somewhat above the elevation of the liquor-spraying nozzles, must be protected from corrosion in various, expensive, ways. The smelt leaves the furnace through smelt spouts, located in one or more furnace walls just above the floor tubes. Ideally, the smelt leaving the furnace should not contain any unburned material—the "dregs".

In the soda process, most of the combustion occurs in suspension and the ash falls to the furnace bottom and leaves the furnace as molten smelt in the same fashion as the other recovery units which fire black liquor.

The floor of the furnace can be horizontal, in which case the smelt-spout openings are generally located some 200 to 300 mm above the floor. Thus, a large pool of smelt collects over the entire floor of this type of furnace, which is called a "decanting" or "flat-floor" hearth, or "decanting" or "flat-floor" furnace. The smelt spouts may be located on one wall, or on two, opposite walls.

The floor of the furnace can be inclined, generally at an angle of 5 to 10 degrees to the horizontal, towards one wall, in which case the smelt-spout openings are located at the lower end of the sloped floor. Much less smelt is present in the bottom of this type of furnace, which is called a "sloping-floor" hearth, or "sloping-floor" furnace.

In some sloping-floor furnaces, the smelt-spout openings are located some 100 to 300 mm above the floor. Thus, a small pool of smelt also collects in this type of furnace. For the purposes of this discussion, this type of furnace is also designated a "sloping-floor" hearth, or "sloping-floor" furnace.

Ideally, the char should be distributed over the entire hearth area, completely covering the molten smelt. Ideally, the molten smelt consists of sodium sulphide ($Na_2S$) and sodium carbonate ($Na_2CO_3$). This even spreading maximizes the surface area of the char bed exposed to the combustion air and also protects the smelt from oxidation of sodium sulphide to $Na_2S_2O_3$, $Na_2SO_3$ and $Na_2SO_4$.

Excessive local deposition of liquor on the char bed causes local combustion upsets which, although not necessarily enough to disrupt the overall operation of the boiler, can cause local temperature variations. The local temperature variations adversely affect the TRS emissions from the furnace, as discussed below.

If an excessive quantity of wet liquor is deposited on any area of the char bed, the combustion in that area is suppressed, the bed builds up there and local combustion falters or ceases and causes a "black-out" in that area of the bed on which the wet liquor has been deposited. As a result of these black-outs, bed temperatures decrease in these regions and this causes an increase in the emission of sulphurous gases from these regions. If these sulphurous gases are imperfectly combusted, they contribute to the strength of rotten-egg-like odour typically emitted from such boilers. If the black-out is severe, expensive support fuel such as fuel oil or natural gas is required to restore the combustion and it may be necessary also to cease firing the liquor temporarily. If the char pile in the affected area becomes too high, it can topple over and block the primary air ports and/or cause char and molten smelt to enter the registers which feed air to the primary air ports. In such instances, the boiler generally must be shut down to clean out the registers and repair any damage which may have resulted.

Blackouts may also cause excessive accumulations of combustible gases in the furnace; these accumulations eventually ignite and, if sufficiently large, the resulting explosion can damage the boiler.

Piles of char can build up in the corners of the char bed and block the auxiliary-fuel burner ports located there, hindering or preventing operation of the burners.

The primary air system proposed in the method minimizes such upsets.

If the combustion in some area of the char bed is too intense, as a result of the local introduction of excessive quantities of combustion air, the surface of the char bed becomes too hot and excessive chemical fume is generated. This fume can condense on the pendent heating surfaces of the boiler. The fume particles increase the dust loading in the flue gases and add to the capacity requirements of the electrostatic precipitator, a device used to remove particulate from the flue gases before they are discharged to atmosphere.

Also, if the combustion in some area of the char bed is too intense, the char may be burned away completely and molten smelt may be exposed and will be subject to oxidation.

It is important to efficient boiler operation that the combustion of the injected liquor is completed as low down in the furnace as possible in order to minimize the gas temperatures in the pendent heating surfaces of the boiler. Excessive gas temperatures in the upper furnace are adverse because they cause the gas-borne particles to become sticky, semi-molten, or molten, in which state they can adhere strongly to the heating surfaces. For the same reason, the liquor-spray particles should be retained in the lower furnace and burned there rather than have them carried into the upper furnace, either to burn, causing local high temperatures, or to adhere to the heating surfaces as unburned liquor.

Deposits which adhere to the heating surfaces reduce the heat-transfer to the surfaces. As much of these deposits as possible is therefore removed, using devices such as soot-blowers which generally utilize steam or high-pressure air, at considerable cost. It is therefore important to minimize the entrainment, or carryover, of liquor-spray particles and chemical fume in the flue gases rising from the furnace and to complete the combustion at as low an elevation in the furnace as possible. The method improves combustion and reduces the carryover of liquor-spray particles and particles of char.

The primary air ports in recovery boilers are particularly subject to fouling and eventual blockage from frozen smelt and dried liquor. In modern boilers, the primary air ports are fitted with automatic port rodders, which are devices for cleaning the ports. These port rodders are expensive, require maintenance and obstruct access around the boiler at this elevation. The invention reduces this port-fouling and minimizes the need for port rodding, either manually or by the use of automatic port-rodding equipment.

Combustion Air Systems in Recovery Furnaces Firing Black Liquor

As noted above, the combustion air is admitted to this type of recovery furnace in several zones, which are named according to their elevations relative to the char bed. Successively higher zones are named primary, secondary, tertiary and, in the latest furnaces, quaternary air, etc. Thus, the primary air is the air zone closest to the char bed. A typical furnace with a flat floor and three levels of combustion air is shown in FIG. 1.

Some older boilers have only two air zones: one primary air system below the liquor guns and one secondary air system above the liquor guns.

Other older boilers and most modern boilers have at least three air zones: two below the liquor guns and one above the liquor guns.

An increasing number of modern boilers have four or more air zones: generally two zones below the liquor guns and the remaining zones above the liquor guns.

The primary air zone is generally about a metre above the furnace floor and is always below the elevation of the liquor guns.

The secondary air zone is generally one or two metres above the primary air zone and, except in older boilers of a certain design, is always below the elevation of the liquor guns.

The tertiary and quaternary air zones are almost always above the elevation of the liquor guns.

The air ports of each zone are generally at a common elevation, but need not be. The openings through which the air is admitted, the air ports or nozzles, are located on one or more walls of the furnace. The furnace is, typically, rectangular in horizontal cross-section. The ports on each wall are usually distributed evenly across the width of the wall or may be spaced according to the manufacturer's preference. The combustion air enters the ports from air registers which extend across all or part of each furnace wall.

Around the perimeter of the furnace, the surface of the char bed is generally slightly below the primary air ports. In a conventional furnace with primary air from all four walls, the char may pile up in random heaps, 1 or 2 m high, to the extent that the top of the char bed may be cut off by the secondary air jets.

The gas-flow pattern in a recovery furnace is created largely by the combustion air system.

Older recovery boilers may have only one combustion air fan. More modern boilers generally have a separate fan for each primary, secondary and tertiary air system, etc.

The Primary Air System

Conventionally, the primary air is introduced through multiple ports in four walls and the flow through all the individual ports is generally more or less equal. In most boilers, the quantity of air originating from each wall is approximately the same. The primary air jets from the ports on the four walls create a central column of rapidly-upward-flowing flue gases, as shown in FIG. 2. This central gas column entrains liquor-spray particles and other particulate and carries them out of the furnace. This carryover material can cause fouling of the heating surfaces and overloading of ash hoppers. The other, higher, air zones of the boiler can destroy, modify or reinforce the central column of rapidly-upward-flowing flue gas which carries liquor-spray particles and other particulate out of the furnace.

The inventors believe that the last recovery boiler in the world which had primary air ports on two walls only was at Tasman Pulp and Paper Limited in New Zealand, discussed previously under Prior Art. This small, old boiler shut down in early 2000.

In a conventional flat-floor furnace, the primary air jets are generally directed into the furnace at an angle of 0 to 5 degrees downwards from the horizontal, as shown in FIG. 3. The primary air ports are all at a common elevation.

In a conventional sloping-floor furnace, the primary air jets are generally directed into the furnace at an angle of approximately 30 degrees downwards from the horizontal, and originate from air ports located along the sides of a flat plane which is inclined more or less parallel to the furnace floor, as shown in FIG. 4. The primary air ports on the front and rear walls are generally located along the other two, horizontal, sides of the said sloping plane.

The primary air registers are generally short and each register may have 4 to 10 small air ports, each port typically rectangular and 50 mm wide and 100 to 200 mm high. Each register has, typically, a single damper which controls the flow of air to the register, but there is most-often no damper in each port to provide a jet with a constant velocity.

Some boilers are equipped with a high-primary air system. This is a system of air ports, perhaps as much as 1 m above the primary air elevation, and supplied with air from ducting tapped off the ducting for the primary air system. A booster fan fed from the primary air system may be employed for the high-primary air.

Primary Air System Problems

Weak primary air jets result in poor mixing of the combustion air with the combustibles in the furnace. Poor mixing causes inefficient combustion, causes excessive emissions of TRS (total reduced sulphur) gases, carbon monoxide and fume, unnecessarily low smelt-reduction efficiencies and may cause problems with char-bed control and smelt run-off.

Ineffective combustion air systems may have weak air jets which fail to penetrate sufficiently far into the furnace, thus starving the centre of the furnace of oxygen. Alternatively, the air jets may be strong, but directed steeply downwards, creating a hot zone around the perimeter of the hearth and a char rampart which prevents the jets penetrating farther into the furnace.

Ineffective combustion air systems fail to distribute the heat evenly across the surface of the char bed, creating regions of higher and lower temperatures. Fume emission can be excessive from the high temperature regions. The temperature in the low-temperature regions can be sufficiently low that the smelt may freeze or partially freeze in these regions, creating smelt dams which restrict the flow of smelt on the floor of the furnace. When such dams melt, then the resulting surges of smelt flow can cause explosions in the dissolving tanks into which the molten smelt is discharged from the furnace.

In a flat-floor furnace with a conventional combustion air system, the primary air ports on all four walls are generally all at the same elevation, as shown in FIG. 3. The primary air jets, directed horizontally or very slightly downwards at an angle of 0 to 5 degrees, are directed in essentially the same horizontal plane. The air velocity in the primary air ports is of the order of 25 to 30 m/s and, since the jets are small, they penetrate only some 2 m into the furnace. The profile of the char bed is relatively flat in a flat-floor furnace, particularly around the periphery of the furnace where the small primary air jets sculpt the char bed, often forming a low char rampart around the periphery of the furnace. Inside the peripheral band affected by the primary air jets, the char bed can be higher, with randomly-located piles of char, since this area is unaffected by the relatively weak primary air jets.

In a sloping-floor furnace with a conventional air system, as shown in FIG. 4, the primary air ports on the spout wall are all at one elevation, designated P5 on FIG. 4. The primary air ports on the wall opposite the spout wall are also at a single, higher, elevation, designated P1 on FIG. 3. The ports on the other two walls, designated the sidewalls for the purposes of this discussion, are typically arranged in horizontal groups of several ports, each group served by a register, and arranged such that the ports served by each register are at a common elevation, while the registers are located at descending elevations, designated P1 through P5 on FIG. 4. The sidewall registers are thus more or less on the sides of a plane P1-P5 which is inclined and parallel to the sloping floor of the furnace. Typically, all the primary air jets are directed downwards at an angle of approximately 30 degrees, as noted above.

In a sloping-floor furnace, as shown in FIG. 4, the profile of the char bed is not relatively flat like the bed in the flat-floor furnace. In a sloping-floor furnace, the small primary air jets, directed downwards at approximately 30 degrees, as noted, keep the char burned back, away from the furnace walls around the periphery of the furnace, forming a steep char rampart about 1 to 1.3 m from the walls of the furnace as shown in FIG. 3. This rampart impedes air-jet penetration and deflects the air jets upwards into the furnace. In the region inside the char rampart created by the primary air jets, the char bed is higher and this area is completely unaffected by the primary air jets which are contained by the char rampart.

Thus, in both the flat-floor and sloping-floor furnaces that have conventional four-wall primary air, the primary air is confined to a relatively small area around the perimeter of the furnace. Since the oxygen in the air jets is restricted to a confined area, the temperatures near the walls are unnecessarily high, causing local, excessive $NO_x$ and fume generation; metal wastage can also occur. On the other hand, the centre of the furnace at this elevation is relatively cooler. In the cooler region in the centre of the char bed surface, TRS emissions may be excessive.

Conventional thinking suggests that to minimize fume generation and metal wastage in the lower furnace, the combustion should be delayed and displaced to higher elevations in the furnace. Typically, the primary air flow is reduced and the air flows at the other, higher elevations are increased correspondingly. This reduces the temperature immediately above the smelt bed around the perimeter of the furnace and reduces fume generation and metal wastage. However, the lower temperature generally results in lower reduction efficiencies and sometimes higher TRS emissions from the furnace. The extremely expensive heating surface of the furnace is underutilized and the boiler thermal efficiency suffers.

Further, Prouty, Stuart and Caron indicated in their paper "Nitrogen oxide emissions from a kraft recovery furnace" (Tappi, Vol. 76, No. 1) that although the $NO_x$ emissions were reduced when the oxygen concentration was reduced, the carbon monoxide emissions increased five-fold. In the technical paper "Novel air systems for kraft recovery boilers", presented at a meeting of the Black Liquor Recovery Boiler Advisory Committee (BLRBAC), in Atlanta, Ga., USA, on 6 Oct. 1993, Colin MacCallum explained that decreases in the primary and secondary air quantities reduce both gas mixing and combustion at these elevations. The reduced gas mixing allows the oxygen-rich zone around the perimeter of the char bed (where the primary jets are), and the CO-rich zone in the centre of the furnace, to persist, rather than be eliminated by the combustion which is promoted by the secondary air jets which would be more aggressive at a higher flow.

Combination of Jets

When an air jet discharges into a free space, it spreads with an included angle of about 30 degrees. Thus, jets which originate from ports which are close together, combine a short distance from the wall on which the ports are located. Thus, in a conventional primary air system, the jets from each register combine to form a wide jet. Furthermore, if the registers are close together, as is typically the case, then all the ports on each wall are essentially equally spaced across the wall; then, the wide jets from each register combine to form a single, very wide jet from that wall; this very wide jet is sometimes referred to as a plane jet.

If the registers are farther apart, then the wide jets from each register will not combine until they flow farther out into the furnace.

For the purposes of this discussion, this combination of jets is referred to as the "register effect". The register effect can be used to create the desired jet arrangements, for example, the partially-interlaced arrangement of air jets in the method. FIG. 7 shows a large jet created by the combination of two smaller jets, either in plan or in elevation. Thus, for ease of manufacture, the air ports can be all the same size, while the large jets are created by combining two or more small jets.

Large jets can be created by rows, columns, groups or clusters of smaller jets, or by increasing the pressure at the air port or combination of ports. A cluster of ports is defined herein as a group of closely-spaced ports with some of the ports in the group being at one elevation and the remaining ports in the cluster being at one or more different elevations. In the method, each large principal jet can be created by the combination of the several powerful jets from a single register—probably a register for which the inlet damper remains fully open or almost fully open.

Small jets can be created by using a damper to reduce the air flow to one register which, in turn, feeds several primary air ports. The small jets thus created would combine to form a single "small" jet. In the method, a scavenging jet can be formed by the combination of several jets from the same register.

Some boilers have primary air ports equipped with an individual damper at each port opening. Small jets can be created by using this damper to reduce the size of the port and thus reduce the air flow through the port. Again, a single register generally feeds several primary air ports even if the ports have individual port dampers.

A large jet can be formed by, say, five jets from a single register. A small scavenging jet can be formed by, say, two jets from a single register with the same air pressure as the five-jet register. As noted above, where the ports associated with several adjacent registers are spaced more or less equally across the width of a wall, the air jets from these ports become one large jet in the form of a wide, shallow sheet of air—a plane jet. Thus, in the Figures, each arrow may represent a jet formed by the combination of several smaller jets.

In an air system, where an air jet on one wall is opposite a jet on the opposite wall, the jets in this pair of jets can be fully opposed, partly opposed, or non-opposed, as shown in FIG. 5. The opposing jets may or may not issue from ports at the same elevation, but they are directed such that they fully oppose, or partly oppose, or do not oppose the air jets from the opposite wall, as shown.

Size of All Jets

There are practical limitations to the degree of similarity of jet size in an air system. The ports can be manufactured so that, within the manufacturing tolerances, the ports are the same size. However, the ducting systems upstream of the ports always vary and, typically, when the boiler is initially set up for operation, water-filled manometers, or digital manometers, are employed by the service engineers to serve as a guide to adjust the dampers on the air supply to various registers to equalize the pressures in the registers, in an attempt to equalize the size of the jets.

The pressures can be adjusted fairly accurately with cold or hot air before the boiler starts up. However, once the boiler is in operation, furnace pressure fluctuations make it more difficult to equalize the pressures in the registers. Also, the boiler operators adjust the dampers on an as-required, irregular and unscientific basis.

Thus, in the method discussed herein, where the term "equal-sized" is applied to jet size, it does not mean that the jets will be absolutely equal in size; the jets can be expected to be of slightly different sizes in reality.

Size of Principal Jets

When fully-opposed or partly-opposed jets as shown in FIG. 5, are of equal size, the central gas column which is created by a two-wall combustion-air system is a wide column, essentially equidistant from the active walls, as shown in FIG. 6.

In an older, operating recovery boiler having only two levels of air, namely one level of four-wall primary air below the liquor guns and one level of concentric secondary air above the liquor guns, using a camera inserted high up in the furnace sidewalls, looking downwards into the furnace, Blackwell observed that the central column of up-flowing gases in the lower part of the furnace was unstable and shifted suddenly and rapidly from one place to another. In the course of physical model testing of the same boiler to optimize the addition of a two-wall second level of air above the primary level and below the liquor guns, Blackwell found that the flow pattern with equally-strong opposed jets from these two walls was more unstable than the flow pattern developed by balanced partially-interlaced jets from the same two walls. In computational fluid dynamic (CFD) modelling at the University of British Columbia, it was observed that, when two plane jets of similar strength were opposed, the flow pattern above the jets was unstable and the resulting up-flowing gas column shifted away from one wall from which the jets were issuing, towards the opposing wall—and then back again towards the first wall. It was also observed in the CFD modelling that, when the jet from one wall was larger than the jet from the other wall, then the location of the upward-flowing column was displaced towards the weaker jet and was stable.

It is not known if this instability is detrimental to boiler operation, so the method described herein has been devised for both situations, namely:

- with both jets in each opposing pair of principal jets the same size and the total quantity of air from the principal jets on the first active wall the same as the quantity from the opposite wall. The jets in one opposing pair may be larger than the jets in an adjacent pair
- with all the principal jets on the first wall the same size, and all larger than the jets on the second wall
- with the principal jets on the first wall of different sizes, but each jet from the first wall larger than its opposing jet.

In the second and third instances above, the total quantity of air from the principal jets on the first active wall is greater than the quantity from the opposite wall.

Simplified Primary Air Principle

Where air jets issue from air ports on four walls at any elevation, the air jets from each wall interfere with the jets from the adjacent walls at right angles and force the air and the flue gases to flow into a central column of relatively-rapidly-upward-flowing gases. This is shown in plan view in FIG. 2 and, in elevation, in FIGS. 3 and 4.

With a two-wall primary air zone, or "2wp" zone, as shown in FIG. 6, as a component of the proposed method, the total primary air quantity is the essentially the same as, or somewhat less than in the four-wall arrangement. In the method, the quantity of air through the ports on two opposing "inactive" walls is significantly reduced, in the limit to zero, while the quantity of air through the ports of the two opposing "active" walls is, in the limit, therefore essentially doubled; thus, as the quantity of air from the inactive walls decreases, there is less and less interference with the increasingly stronger jets from the active walls. Also, in the limit, where the original total primary air quantity was distributed more or less equally between all four walls, the velocity of the jets issuing from the ports of the two "active" walls is essentially double the velocity of the jets from the same walls in the four-wall arrangement. The more powerful jets of the two-wall arrangement create a column of relatively-rapidly-upward-flowing gases in a region with a rectangular horizontal cross-section, but, as explained below, the upward velocity in this region is lower than the upward velocity in the central column created by the four-wall arrangement of jets. The rectangular region with upflow with 2wp extends across the full extent of the furnace width (or depth) with the long axis of the rectangle parallel to the walls from which the large air jets originate. This is shown in FIG. 6. The more powerful jets entrain more of the surrounding furnace gases, including combustible gases, into the air jets, thereby improving gas mixing and combustion.

Spray particles from the liquor guns and particulate from the char bed can be preferentially captured and entrained by the gases in these high-velocity regions and, as described previously, carried out of the furnace.

It can be seen from FIGS. 2 and 6, that the area of the rectangle in FIG. 6 is greater than the area of the central column in FIG. 2. Since the amount of up-flowing gases is similar in both cases, the upward velocities in the larger rectangular region in FIG. 6 are thus slower than in the central column region in FIG. 2. With lower upward velocities, the flow pattern created by the two-wall primary air-jet arrangement is less likely to entrain liquor-spray particles and char particulate in the upward-flowing gases than the flow pattern created by the four-wall arrangement.

Thus, it can be deduced that, in a system in which a large portion of the primary air is introduced from the ports in two opposing walls, while the remaining portion of the primary air is introduced from the two remaining walls, the liquor-spray carryover will be less than in a furnace with the same total primary air flow distributed such that the flow from each of the four walls is more or less equal, but will be greater than in a furnace in which the same total primary air quantity is introduced from ports on two opposing walls only.

A two-wall primary air arrangement, which is the ultimate embodiment of the proposed method, has more powerful jets issuing from the two active walls as noted above. These powerful jets burn the char bed back farther into the furnace and, where the jets are directed as proposed in the method, essentially eliminate the char ramparts otherwise formed by the four-wall primary-air arrangements. The stronger jets penetrate farther into the furnace and provide better gas mixing. Thus, the better gas mixing provided by two-wall primary air reduces the CO emissions, because, with two-wall primary air, the bed height is controlled by the primary air jets which penetrate deep into the furnace and consume the CO. On the other hand, with the four-wall primary-air system, the relatively weak jets form an oxygen-rich zone around the perimeter of the furnace and never penetrate to the CO-rich zone in the centre of the furnace.

The strong principal jets penetrate farther into the furnace and sweep across the surface of the bed, to the centre of the furnace. This results in more effective combustion across the entire horizontal cross-section of the furnace and leads to higher average temperatures in the lower furnace. The combustion is no longer concentrated around the perimeter, so the temperatures at the walls, especially the walls with the closed ports, or no ports, should be lower and the metal wastage should be less.

As discussed above, in a conventional sloping-floor boiler utilizing four-wall primary air, the char bed is piled up by the downward-steeply-sloping primary air jets from all four walls, into char ramparts parallel to each wall, and about 1 to 2 m from each wall. The top of the char bed is burned off and the height is thus controlled by the secondary air jets which have relatively high velocity in a modern system. This means that a large proportion of the combustion air from both the primary and secondary air systems is injected close to the surface of the bed. Combustion close to the bed promotes high temperatures and fume generation.

On the other hand, the powerful principal jets of the 2 wp system create a flat char bed, subjected only to the action of the primary air jets. The surface of the char bed is well below the secondary air jets. That is, the bed surface is directly affected by less of the total combustion air quantity. Thus, fume generation from the char bed is likely to be lower with two-wall primary air than with four-wall primary air.

With the method, the temperatures at the walls can be further decreased by reducing the primary air quantity in the same way as for the four-wall set-up. With the powerful principal jets of a 2 wp arrangement, a decrease in the primary air quantity has fewer adverse effects than it would have with four-wall primary air. With the method, even with a reduced primary-air quantity, the initial air velocity of the principal jets from the active walls may be 40 or 50 m/s, or higher; that is significantly higher than with a conventional four-wall arrangement, so the char bed is shaped much more easily with less primary air. The combustion will still be more effective than the combustion with the four-wall mode of operation and the furnace will still be utilized more fully, because the combustion is occurring lower in the furnace. Experience has shown that the primary air flow (and total air flow) can be reduced by some 5 percentage points with the method, while maintaining the same degree of char-bed control.

The added expected bonuses of the method are: the furnace is utilized more fully and the overall thermal efficiency is higher.

The powerful principal jets of the 2wp arrangement improve the mixing of the combustion air and the combustibles, thus improving combustion. In improving combustion, the method increases the average temperature of the char bed, increases reduction efficiencies, increases thermal efficiencies and, in specific cases, decreases TRS (total reduced sulphur) emissions and reduces fume generation. The method also minimizes the extremes of upward gas velocity, which minimizes the carryover of particulate such as liquor-spray and char particles; this, in turn, minimizes the build-up of deposits of unburned liquor and/or some of the products of combustion on the heating surfaces of the boilers and reduces erosion of the tubular heating surfaces.

The method also improves the control of the shape and size of the char bed. The method reduces tube-wall metal temperatures and attendant metal wastage in the lower furnace.

The higher velocity of air passing through the principal-jet ports of the two active walls helps to keep those ports clean, thus decreasing the required frequency of manual port-rodding and perhaps eliminating the justification for the purchase of automatic mechanical port rodders. If the boiler is already equipped with mechanical port rodders, the frequency of their operation can be decreased, thus reducing the maintenance requirements.

Scavenging Jets

FIG. 8 is a schematic cross-sectional plan view of a typical recovery furnace, showing, for simplicity, just two of several large principal primary air jets from the two active walls and indicates the regions in the furnace corners where char can accumulate if no scavenging jets are provided. With large principal jets (as individual large jets or as combinations of several smaller jets), there may be a considerable gap between adjacent principal jets and, more likely, between the outermost principal jet and the adjacent inactive wall, so these triangular regions may be quite large. To prevent the accumulation of char in these regions, scavenging jets are provided as part of the method described herein to sweep the char out of the corners and, depending on the spacing of the principal jets, from between adjacent principal jets.

FIG. 9 is a schematic cross-sectional plan view of a recovery furnace using the first embodiment of the method, with fully-opposed principal jets and with scavenging jets in the corners and on the same walls as the principal jets. As noted earlier, in this and other Figures, each arrow may represent a jet formed by the combination of several smaller jets.

FIG. 10 is a schematic cross-sectional plan view of a recovery furnace using the fourth embodiment of the method, with fully-opposed principal jets on the active walls and with scavenging jets and some central jets on the inactive walls.

FIG. 11 is a schematic cross-sectional plan view of a furnace showing the method applied to a typical existing boiler designed for four-wall primary air. When the method was applied to this boiler, the principal jets were fully-opposed, but of different sizes and the flow from each of the two active walls was more or less equal; hence, the central jets were ideally provided at the centre of the inactive walls. There were two sets of scavenging jets in each corner, originating from the inactive walls. Normally, only one set of scavenging jets would be provided, but in this particular boiler, the primary air fan capacity was limited, so the amount of air which could be diverted to the principal jets was limited by the pressure drop in the principal-jet ports and associated registers and ducting; thus, it was necessary to admit more air from the sidewalls to allow operation with the method.

Central Jets

In the method, when the primary air flow is maintained at its four-wall flow rate, but injected through two walls only, the velocity of the air jets from the active walls essentially doubles and the principal jets sculpt the bed profile more easily than the slower jets of the four-wall arrangement.

With powerful principal jets directed in the proposed manner, the bed profile is relatively flat and, in smaller boilers, has a central ridge parallel to the walls from which the principal jets issue. Where the air flow from the active walls is more or less equal, the ridge of the char bed is more or less equidistant from the active walls, that is, across the centre of the furnace. Where the air flow from one first active wall is greater than the flow from the second active wall, then the ridge is closer to the second wall. In furnaces larger than about 9 m square, there may be no central ridge. In a furnace smaller than about 9 m square, originally designed for four-wall primary air, and operating with two-wall primary air, the height of the central ridge of the char bed is generally somewhat higher than the elevation of the primary air ports on the "inactive" walls.

In order to prevent the char and associated smelt from the char-bed ridge from entering the ports on the inactive walls of a furnace originally designed for four-wall primary air, some air is introduced through some air ports which are opposite the ends of the char-bed ridge, on the inactive walls; this air which is introduced from the centre of the inactive walls also sculpts the bed, but more weakly than the stronger jets from the active walls, and pushes the ends of the ridge away from these central air-jet ports. That is, close to the inactive walls, the ridge is lower than the rest of the ridge. These ports, which can be at the centre of the inactive walls, are the "central-jet ports" in the method and are illustrated in FIGS. 10 and 11.

With the method, in a furnace originally designed for the strong principal jets of the method, there is no need for any ports on the inactive walls, so the ridge of the char bed can extend right to the inactive walls. However, if there is a problem with the camera which monitors the char bed, it would be advantageous to have ports at the centre of the inactive walls; the operators could see the char bed through these ports.

The central-jet ports can be in the same plane as the principal jets and the scavenging jets, or they can be at a slightly higher elevation, in which case a higher char bed can be accommodated without any danger of the char entering the central-jet ports. The central-jet ports on one wall can be opposite, but need not be opposite, the central-jet ports on the opposite wall.

In an existing boiler, with multiple ports in existing registers on the inactive walls, the central jets of the method are created by closing the appropriate existing port dampers and/or register dampers to the desired extent. Thus, there may be several sets of central jets on each inactive wall, simply because it proves impossible to shut off the air to the inactive walls entirely, or because additional central jets are necessary to satisfy the fan limitations.

Specific Features of the Method

The method comprises introducing some of the primary air, as one, or more, powerful principal jets, from two opposing furnace walls, the active walls. The principal jets can be all the same size or different sizes. The primary air introduced through the active walls can be distributed more or less equally from each of the active walls. The primary air quantity introduced through one active wall can be greater than the quantity introduced through the opposite wall.

The remainder of the air is introduced as scavenging jets, or as scavenging jets and central jets. The scavenging jets can be all the same size or different sizes. The central jets can be all the same size or different sizes.

The principal jets from each pair of opposite, active walls may be fully opposed or partly opposed as shown in FIG. 5, while the scavenging jets and the central jets from each pair of opposite, inactive walls may be fully opposed, or partly opposed, or non-opposed as shown in FIG. 5. The fully-opposed or partly-opposed jets can be of equal size, or they can be of different sizes. The principal jets from each active wall can all be the same size, but they can be of different sizes. Also, the principal jets from one wall can be larger than the principal jets from the opposite wall, for the reasons explained above.

The momentum flux, defined as the product of the jet's initial velocity and its mass flow, of the principal jets is approximately double or more than double that of the scavenging jets.

As explained above, a fully-opposed arrangement of two-wall primary air jets creates a larger rectangular region of somewhat-less-rapidly upward-flowing gases than the central column of rapidly-upward-flowing gases which is created by a four-wall primary air arrangement. This rectangular region of upward-flowing gases can be eliminated by the use of a partially-interlaced arrangement of the primary air principal jets.

FIG. 12 shows fully-opposed, balanced air jets in plan view, which can be compared with FIG. 13*a*, a plan view of a symmetrical, balanced, fully-interlaced pattern comprising large jets. The fully-interlaced pattern may be symmetrical, but need not be symmetrical, in the principal-jet plane. In a balanced arrangement of fully-interlaced air jets, the large jets are all the same size. In an unbalanced fully-interlaced arrangement, the large jets from one first wall are larger than the large jets from the second wall.

The fully-interlaced pattern of FIG. 13*a* can be compared with FIG. 13*b*, a plan view of a symmetrical, balanced, partially-interlaced pattern comprising large and small air jets, each large jet being opposed by a small jet originating from the opposite wall. The large and small jets from each wall in the partially-interlaced pattern alternate, i.e. they are arranged small/large/small/large, etc. across the width, or depth of the furnace. The partially-interlaced pattern may be symmetrical, but need not be symmetrical, in the principal-jet plane. In a balanced arrangement of partially-interlaced air jets, the large jets are all the same size and the small jets are all the same size. In an unbalanced partially-interlaced arrangement, the large jets from one first wall are larger than the large jets from the second wall; also, the small jets from the first wall are larger, or smaller, than the small jets from the second wall.

In the prior art discussed above, Blackwell and MacCallum demonstrated that a balanced partially-interlaced secondary air-jet arrangement in a horizontal plane minimizes the velocity extremes in the upward-flowing gases in a furnace. Further, Jones, Chapman and Mahaney, in their paper "Improved air port arrangements for the secondary air level" (Pulp & Paper Canada 94:9 [1993]) reported that a partially-interlaced secondary air-jet arrangement in a horizontal plane improves gas mixing.

In the first embodiment of the invention, the primary air not introduced as principal jets is introduced as at least four smaller jets, the scavenging jets, each located on opposite ends of each of the two active walls such that all the principal jets on each active wall are located between the scavenging jets on the same wall and all the ports from which all the jets originate are located on the sides of the principal-jet plane which is horizontal or inclined. In the first embodiment of the invention, there are no ports on the two inactive walls of the furnace. Additional scavenging jets can be located between the principal jets. The first embodiment of the invention, with equal-sized, fully-opposed principal jets, with scavenging jets in the corners, is shown in FIG. 9.

In a second embodiment of the invention, scavenging jets are located on opposite ends of each of the two inactive walls and all the ports from which all the jets originate are located on the sides of the principal-jet plane, which is horizontal or inclined. Additional scavenging jets can be located between the principal jets.

In the third embodiment of the invention, some of the primary air not introduced as principal jets is introduced as scavenging jets from the active walls, as in the first embodiment. The remainder of the primary air is introduced as other jets, the central jets, from the inactive walls. The momentum flux of the central jets is less than that of the principal jets.

In the fourth embodiment of the invention, shown with equal-sized, fully-opposed principal jets in FIG. 10, the primary air not introduced as principal jets is introduced as scavenging jets and central jets from the inactive walls, such that scavenging jets are located at the opposite ends of the inactive walls, and the central jets are located such that the vertical centrelines of all the ports from which the central jets issue are between the two sets of scavenging jets on each inactive wall. Additional scavenging jets can be located between the principal jets.

In all the embodiments of the invention, the ports from which the scavenging jets originate are located on the sides of the principal-jet plane.

In the third and fourth embodiments, the central jets can be located in the centre of the inactive walls. The central jets need not be located in the centre of the inactive walls. The central-jet ports on one wall can be opposite the central-jet ports on the opposite wall. The central-jet ports on one wall need not be opposite the central-jet ports on the opposite wall. The central-jet ports may be located in the principal-jet plane, but can be located on a second plane which is above and may be parallel to the principal-jet plane.

The primary air introduced through the inactive walls can be distributed more or less equally from each of the inactive walls. The primary air quantity introduced through one inactive wall can be greater than the quantity introduced through the opposite wall.

The planes can be horizontal, or inclined in the direction of the principal-jet flow as shown in FIG. 14, inclined at right angles to the direction of the principal-jet flow as shown in FIG. 15, or essentially parallel to the floor in a sloping-floor furnace. The planes can be flat, or curved, with one or more sides flat or curved as shown in FIGS. 16, 17, 18 and 19. Further, the large principal air jets are directed more or less in the principal-jet plane, or slightly downwards, or slightly upwards, while the smaller scavenging air jets and the central jets may be steeply sloping downwards, or directed more or less in the plane, or slightly downwards, or slightly upwards.

In the method, when the plane of the principal jets is inclined, as shown in FIG. 14 for example, the principal jets from the active walls can originate as shown in FIG. 20, along either the horizontal sides, P1 and P5, of the plane, on the front and rear walls, or on the sloping sides, P1-P5, of the plane, on the sidewalls, or, in a specific case, parallel to the sloping floor of the furnace. FIG. 21 shows the principal jets from the spout wall and from the wall opposite the spout wall; the scavenging air jets are not shown. FIG. 22 shows a section through Register P3 of the furnace where the principal air jets are introduced from the sidewall registers at elevations P1 through P5; again, the scavenging air jets are not shown.

Typically, fully-opposed principal jets will penetrate up to halfway across the furnace. The large principal jets in a partially-interlaced arrangement will penetrate two-thirds to three-quarters or more of the way across the furnace and the small principal jets opposite the large jets will penetrate one-third to one-quarter or less of the way across the furnace.

The scavenging jets will penetrate some 1 to 2 m into the furnace, depending on the location of the scavenging jets and on the distance from the corners of the inactive walls to the outermost principal jets.

In a boiler designed for two-wall primary air, the central jets will generally penetrate up to halfway across the furnace, but, where the central jets on one wall are not opposite the central jets on the opposite wall, they may penetrate farther across the furnace. In an existing boiler, the intent would be to minimize the air flow to the existing ports on the inactive walls, so the central jets would penetrate only a short distance into the furnace unless it proved impossible to close existing dampers; where it was possible to adjust existing dampers properly, or in a boiler designed for two-wall primary air, the momentum flux of the central jets could be as little as half that of the principal jets.

Typical air pressures in the registers at full boiler load are 1 to 2 kPa gauge for the principal jets and 0.2 to 1 kPa gauge for the scavenging jets and central jets.

The inventors believe that the most effective primary air system is a true two-wall arrangement (that is, an arrangement with jets from two walls only) employing partially-interlaced air jets and scavenging jets, discussed below. In this case, automatic port-rodding equipment is required on two walls only—at a significant capital cost saving. However, in an existing boiler, it may not be possible to implement a true two-wall arrangement in all circumstances. In these instances, benefits can still be achieved by admitting some of the primary air from the inactive walls.

Application to an Existing Boiler

The proposed method employing powerful principal jets can be applied to sloping-floor furnaces and flat-floor furnaces. In the method, when applied to an existing sloping-floor furnace with four-wall primary air, some, or most, of the primary air would be shut off from two opposing walls. The primary air thus shut off would be directed to the other two walls in roughly equal proportions. Thus, the primary air quantity from the remaining two "active" opposing walls would be correspondingly increased, such that the total primary air quantity remained substantially the same as before. That is, the velocity in the principal-jet primary air ports of the active walls would increase, or, in the limit, would double. The remaining small quantity of primary air, as applicable, would be essentially equally distributed between the two "inactive" walls.

A typical application to an existing boiler is shown in FIG. 11, discussed earlier. In this particular example, the ports which create the scavenging jets are the existing ports on the inactive walls, close to the furnace corners. In this boiler, the central jets happen to be opposite each other, at the centre of the inactive walls. In some boilers where it is impossible to shut off the air to some of the ports on the inactive walls because of faulty dampers, there may be several sets of central jets on each inactive wall.

If the method were applied to a sloping-floor furnace using the existing steeply-sloping ports, the more powerful principal air jets from the two active walls might cut into the char bed and could damage the floor tubes. To avoid such damage, the principal jets from the two active walls must be directed more or less horizontally from the sidewalls or, in a conventional furnace with a sloping floor, directed essentially parallel to the floor from the front and rear walls. Therefore, new primary air ports in the active sidewalls, directed more or less horizontally, would be installed; alternatively, new primary air ports designed to direct the principal jets essentially parallel to the floor would be installed in the front and rear walls. As an alternative to new air ports, inserts could be installed in existing ports to direct the primary air at the desired angle from the active walls. The conventional arrangement of such ports angled downwards at approximately 30 degrees is shown in FIG. 23 and a simple insert to direct the air at the desired angle is illustrated in the same figure.

The air ports in the inactive walls need not be modified, since the jets contain a smaller quantity of air. For example, there may be small jets formed by leakage of air through the dampers; such air jets are relatively weak.

Summary of Specific Features of the Invention

The methods and apparatus can be applied to new, retrofitted, or existing boilers as follows:

- a recovery boiler furnace firing black liquor from the kraft process, from the soda process, from the sodium-based sulphite process, or from the closed-cycle CTMP process, which utilizes injected combustion air, and comprising an arrangement of air ports for introducing some of the primary combustion air at the lowest elevation into the furnace, as powerful principal jets from air ports located essentially along two so-called "active" opposite sides of a plane, the "principal-jet plane". This plane can be horizontal, inclined, flat, or curved. The plane can be inclined in the direction of the principal-jet flow, inclined at right angles to the direction of the principal-jet flow, or essentially parallel to the floor in a sloping-floor furnace. The principal air jets from these ports on the active sides of the plane are arranged in a fully-opposed, or partly-opposed pattern of equally-sized jets, or different-sized jets, or in a fully-interlaced pattern of equally-sized jets or different-sized jets, or in a partially-interlaced pattern of large and small air jets. In the partially-interlaced pattern, each large jet is opposed by a small jet originating from the opposite wall. The large and small jets in the partially-interlaced pattern alternate; i.e. they are arranged small/large/small/large, etc. across the width, or depth of a furnace. The fully-interlaced pattern and the partially-interlaced pattern may be symmetrical, or asymmetrical, in the principal-jet plane.

The fully-interlaced pattern and the partially-interlaced pattern can be balanced or unbalanced. The primary air introduced through the active walls can be distributed more or less equally from each of the active walls. The primary air quantity introduced through one active wall can be greater than the quantity introduced through the opposite wall. The principal air jets may be directed in the plane, or directed slightly downwards, or slightly upwards from the plane, such that the jets in each opposing pair may be fully opposed or partly opposed.

Ports for the scavenging air jets are always located in the principal-jet plane and may be located at opposite ends of the same walls as the principal jet ports, or at opposite ends of the other two opposing, so-called "inactive" sides of the plane, through which the remainder of the air, or no air, is introduced. Additional scavenging jets can be located between the principal jets. The scavenging jets can be all the same size. The scavenging jets can be different sizes.

The momentum flux of the large principal jets is approximately double or more than double that of the scavenging jets.

One or more central jets on each inactive wall may be provided. When the scavenging jets are located on the inactive walls, the central jets are located with their vertical centrelines between the two sets of scavenging jets on each wall. The central jets can be located in the centre of the inactive walls. The central-jet ports on one wall can be opposite the central-jet ports on the opposite wall. The central-jet ports on one wall need not be opposite the central-jet ports on the opposite wall. The central-jet ports may be located in the same plane as the other ports, but can be located on a second plane which is above and may be parallel to the first plane.

The momentum flux of the central jets is less than that of the principal jets.

The scavenging jets may be fully opposed, or partly opposed, or non-opposed. The central jets may be fully opposed, or partly opposed, or non-opposed.

The primary air introduced through the inactive walls can distributed more or less equally from each of the inactive walls. The primary air quantity introduced through one inactive wall can be greater than the quantity introduced through the opposite wall.

Where all the primary air is introduced as principal jets and scavenging jets through ports on the active sides of the plane, there need be no ports on the inactive sides of the plane.

Any of the types of jets can issue from air ports which are in horizontal groups, each of whose centres is essentially on the sides of the said plane or planes.

One fan may be provided to supply combustion air for the principal jets and the scavenging jets and the central jets. Alternatively, separate fans can be provided to supply combustion air for the principal jets, or for the scavenging jets, or for the central jets, or for the scavenging jets and the central jets.

In the furnace, there are many ways of arranging the air ports in order to create the large and small jets featured in the various arrangements:

small ports can be used to create the small jets; large ports can be used to create the large jets groups or clusters of small ports can be used to create each small jet; groups or clusters of large ports can be used to create each large jet groups or clusters of small ports can be used to create each small jet, while larger groups or clusters of similarly-sized small ports can be used to create each large jet. For example, each small jet can originate from a single port and each large jet can originate from a pair of similarly sized ports. Some or all of the area of the single port can be substantially opposite to at least some of the area defined by the pair of ports, as shown in FIG. 24. Some or all of the area of the single port can be opposite the area defined by the pair of ports.

the ports can be of similar size and number and the large jets can be created by a higher air pressure than the pressure creating the small jets.

Coordination of Liquor-spraying and Air Systems

When a central region of relatively rapidly upward-flowing gases is created by a four-wall or two-wall primary air-jet arrangement, the flow region may persist to an elevation above the liquor guns, for many arrangements of secondary, tertiary and quaternary air ports. In this instance, it is advantageous to avoid spraying the liquor into the high-upward-velocity region and, instead, to spray the liquor into the regions where the furnace gases tend to be flowing downwards.

The down-flow of the furnace gases around the central column of upward-flowing gases, as illustrated in FIGS. 3 and 4, is created by the entrainment of furnace gases into the primary air jets. The more powerful the primary air jets, the more pronounced is the down-flow region which is created by the jets.

The liquor particles sprayed into these regions of downward-flowing gases tend to be carried downwards on to the char bed. Thus, coordination of the liquor spraying and the arrangement of powerful principal air jets can result in fewer liquor-spray particles being carried out of the furnace by the flue gas stream.

The method provides well-defined regions of downward-flowing furnace gases, along the active walls, into which regions the liquor particles can be sprayed, to minimize carryover of liquor-spray particles and particulate in the flue gas leaving the furnace. Liquor particles which are inadvertently sprayed into the central, upward-flowing region formed by the powerful principal air jets of the two-wall primary-air arrangement are less liable to be entrained than with the four-wall primary air arrangement, because the upward velocity in the central region is lower with the two-wall primary-air arrangement than with a four-wall arrangement, as explained earlier.

Thus, coordination of the liquor spraying with the air system is particularly complementary to the method with fully-opposed jets, which create two well-defined down-flow regions—each being the full width of the furnace, above the principal air jets. The liquor can be sprayed into these down-flow regions; the liquor-spray particles then fall to the char bed at places where a large amount of oxygen is supplied via the high-velocity principal jets. Both the large oxygen supply and the high velocity of the jets enhance the burning of the char. This allows operation with a larger liquor-spray particle size which also helps to reduce entrainment, or carryover, of liquor-spray particles. The high-velocity principal air jets also facilitate shaping of the bed, as mentioned.

With partially-interlaced principal jets, the upward velocity extremes in the furnace are minimized, so the average upward velocity essentially prevails over the entire horizontal cross-section of the furnace at the primary elevation. In this case, there are no distinct down-flow regions created by the primary air system. However, the liquor should nonetheless be sprayed on to the char bed in front of the active walls since these regions have the largest amount of oxygen available and the jets have the highest velocity close to the walls. Many of the liquor-spray particles reaching the primary zone are then swept horizontally into the centre of the furnace, while the liquor-spray particles falling between the principal jets, fall to the char bed in these regions.

As will be apparent to those skilled in the art, in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention, in which an exclusive property or privilege is claimed, are defined as follows:

1. A method of introducing primary air in two or more portions at a lowest air zone into a furnace firing black liquor from a kraft recovery process, the furnace firing black liquor from a soda process, the furnace firing black liquor from a sodium-based sulphite process, or the furnace firing black liquor from a closed-cycle CTMP process, said method comprising:

a) introducing a portion of the primary air in a jet pattern created by a number of first principal jets from along a first active side of a principal-jet plane and said pattern also being created by a number of second principal jets from along a second active side of the said principal-jet plane opposite to the first side, the plane being bounded, respectively, by a first active wall and a second active wall opposite to the first active wall of the interior of the furnace and by a third inactive wall and a fourth inactive wall, of the interior of the furnace, the said plane being essentially flat, or, a first side of the said plane being curved to form a shallow arch, or both the first and second sides of the said plane being curved to form a shallow arch;

b) directing the said principal jets in a fully-opposed or partly-opposed juxtaposition relative to the principal-jet plane;

c) introducing a portion of the primary air as third and fourth pairs of scavenging jets or pairs of sets of scavenging jets located in the principal-jet plane, each scavenging jet or set of scavenging jets being at opposite ends of the active walls, or at opposite ends of the inactive walls, or at opposite ends of the active walls and between each principal jet, or at opposite ends of the inactive walls and between each principal jet, such that the scavenging jets are of similar size or of different sizes and d) where the portions of the primary air which are introduced as principal jets and scavenging jets are together less than the total quantity of primary air, introducing the remainder of the primary air, as fifth and sixth central jets or sets of central jets or groups of central jets, located on the inactive walls, in the principal-jet plane, or located in a second plane above the principal-jet plane, such that the central jets are of similar size or of different sizes and such that the vertical centrelines of all the ports from which the central jets issue are close to the centre of each inactive wall or are between the two sets of scavenging jets on each inactive wall;

e) having an average momentum flux of the principal jets approximately double, or more than double, the average momentum flux of the scavenging jets, where the momentum flux is defined hereinafter as the product of the jet's initial velocity and its mass flow;

f) having an average momentum flux of the central jets less than the average momentum flux of the principal jets and different from the average momentum flux of the scavenging jets;

g) directing the scavenging jets and central jets in a fully-opposed or partly-opposed or steeply-sloping-downwards juxtaposition relative to the principal-jet plane or the plane above the principal-jet plane, as applicable.

2. The method according to claim 1 wherein:
the central jets on one inactive wall are located opposite the central jets on the other inactive wall.

3. The method according to claim 1 wherein:
the central jets are located essentially at the centre of the inactive walls.

4. The method according to claim 1 wherein:
the said principal-jet plane is horizontal.

5. The method according to claim 1 wherein:
the said principal-jet plane is inclined such that the direction of the incline is in the direction of flow of the principal jets.

6. The method according to claim 1 wherein:
the said principal-jet plane is inclined such that the direction of the incline is at right angles to the direction of flow of the principal jets.

7. The method according to claim 1 wherein:
the said principal-jet plane is inclined parallel to the floor of the furnace.

8. The method according to claim 1 wherein:
the quantities of air from each of the two inactive walls of the said furnace are essentially equal.

9. The method according to claim 1 wherein:
the quantities of air from each of the two inactive walls of the said furnace are not equal.

10. The method according to claim 1 wherein:
the said air is distributed such that the said principal jets are all of similar size.

11. The method according to claim 1 wherein:
the said air is distributed such that the said first principal jets are similarly sized and the said second principal jets are also similarly sized and are larger than the first principal jets.

12. The method according to claim 1 wherein:
the said air is distributed such that the said first principal jets are of different sizes and each said second principal jet is essentially the same size as the first principal jet which it fully opposes or partly opposes.

13. The method according to claim 1 wherein:
the said air is distributed such that the said first principal jets are of different sizes and all the said second principal jets are larger than their respective fully-opposed first principal jets.

14. The method according to claim 1 wherein:
the said air is distributed such that the said first principal jets are of different sizes and all the said second principal jets are larger than their respective opposing first principal jets by a common ratio.

15. The method according to claim 1 wherein:
the said air is distributed such that the said principal jets are arranged in a balanced partially interlaced pattern, comprising large and small principal air jets, each large jet being fully opposed or partly opposed by a small jet originating from the opposite wall, such that each large jet from each active wall alternates with a small jet from the same active wall and wherein the large jets are essentially all the same size and the small jets are all essentially the same size, such that the pattern is symmetrical in the principal-jet plane with the flow from one active wall greater than the flow from the other active wall, or such that the pattern is asymmetrical in the principal-jet plane with the flow from one active wall essentially the same as the flow from the other active wall.

16. The method according to claim 1 wherein:

the said air is distributed such that the said principal jets are arranged in an unbalanced partially interlaced pattern, comprising large and small principal air jets, each large jet being fully opposed or partly opposed by a small jet originating from the opposite wall, such that each large jet from each active wall alternates with a small jet from the same active wall and the large jets from the first wall are essentially the same size and are larger than the large jets from the second wall and the small jets from the first wall are essentially the same size and are larger, or smaller, than the small jets from the second wall and the large jets from the second wall are essentially the same size and the small jets from the second wall are essentially the same size and the pattern is symmetrical, or asymmetrical, in the principal-jet plane.

17. The method according to claim 1 wherein:

the principal jets and the scavenging jets and central jets featured in the said jet pattern originate from ports of similar size or groups of ports of similar size, and dampers at the port openings are closed to the desired degree to create the principal jets, the scavenging jets and the central jets.

18. The method according to claim 1 wherein:

the principal jets and the scavenging jets and central jets featured in the said jet pattern originate from ports of similar size or groups of ports of similar size and number and the principal jets are created by a higher air pressure than the pressure creating the scavenging jets and the pressure creating the central jets.

19. The method according to claim 18 wherein:

the air-pressure differences between the principal jets and the scavenging jets and central jets are obtained by the adjustment of dampers in the ducting upstream of the ports from which the jets issue.

20. The method according to claim 18 wherein:

the air pressures required for the principal jets, or for the scavenging jets, or for the central jets are provided by separate fans.

21. The method according to claims 11 or 12 or 13 or 14 or 15 or 16 wherein:

the large and small principal jets featured in the air-jet pattern originate from corresponding large and small ports.

22. The method according to claims 11 or 12 or 13 or 14 or 15 or 16 wherein:

each small principal jet featured in the air-jet pattern originates from a group or cluster of small ports and each large principal jet originates from a group of closely-spaced large ports at the same elevation or a cluster of large ports, where a cluster of ports is a group of closely-spaced ports with some of the ports in the group being at one elevation and the remaining ports in the cluster being at one or more different elevations.

23. The method according to claims 11 or 12 or 13 or 14 or 15 or 16 wherein:

each small principal jet featured in the air-jet pattern originates from a single port or from a group or cluster of similar-sized ports and each large principal jet originates from a larger group or cluster of ports of similar size to the ports from which the said small jets originate.

24. The method according to claim 23 wherein:

each small principal jet featured in the partially-interlaced pattern originates from a single port and each large principal jet originates from a pair of ports, each of similar size to the single port which creates the small jet.

25. The method according to claim 24 wherein:

some or all of the area of the single port is substantially opposite to at least some of the area defined by the pair of ports.

26. The method according to claim 24 wherein:

some or all of the area of the single port is opposite the area defined by the pair of ports.

27. The method according to claim 1 wherein:

the principal jets issue from a single port or air ports which are in horizontal groups each of whose centres is essentially on the sides of the said plane or planes.

28. The method according to claim 1 wherein:

the spacing between the principal jets is essentially the same.

29. A primary air system in a primary air zone in a recovery boiler furnace having four walls and which utilizes injected combustion air and firing black liquor from a kraft process, the recovery boiler furnace firing black liquor from a soda process, the recovery boiler furnace firing black liquor from a sodium-based sulphite process, or the recovery boiler furnace firing black liquor from a closed-cycle CTMP process, said primary air zone, being a lowest air zone through which some of the combustion air is introduced into the said furnace and said primary air system comprising:

a) a first set of principal-jet ports located on a first active wall of the interior of the furnace, essentially along a first active side of a principal-jet plane which has two active sides and two inactive sides;

b) a second set of principal-jet ports located on a second active wall opposite the first active wall, essentially along the second active side of the principal-jet plane, which is essentially flat, or, the first side of the principal-jet plane is curved to form a shallow arch, or, both the first and the second sides of the principal-jet plane are curved to form a shallow arch;

c) said principal-jet ports arranged such that some of the primary air is introduced through the principal-jet ports, as first and second principal jets or groups or clusters of principal jets and being oriented such that the principal jets are directed in a fully-opposed or partly-opposed juxtaposition relative to the principal-jet plane;

d) third and fourth sets of single scavenging-jet ports or groups or clusters of scavenging-jet ports, located at the opposite ends of the active sides of the principal-jet plane, or located at the opposite ends of the inactive sides of the principal-jet plane, or located at the opposite ends of the active sides of the principal-jet plane and between the principal jets, or located at the opposite ends of the inactive sides of the principal-jet plane and between the principal jets, such that the jets from the outermost scavenging-jet ports may be larger or smaller than the jets from the innermost scavenging-jet ports;

e) on the third, inactive, wall, such that their vertical centrelines are close to the centre of the wall or are between the two sets of scavenging jets on the wall, no ports, or a first central-jet port, or set of first central-jet ports, or more than one set of first central-jet ports, said set or sets consisting of similar-sized ports or similarly-sized groups or similarly-sized clusters of ports, located either on the third side of the said principal-jet plane or on a plane above the principal-jet plane;

f) on the fourth, inactive, wall, such that their vertical centrelines are close to the centre of the wall or are between the two sets of scavenging jets on the wall, no ports, or a second central-jet port, or set of second central-jet ports, or more than one set of second central-jet ports, said set or sets of second central-jet ports comprising ports similar in size, but not necessarily in number, to those of the said first central-jet port or ports located on the same plane as the central-jet ports on the third wall, such that the central-jet ports on one inactive wall are essentially opposite, or not opposite, the central-jet ports on the opposite wall;

g) the quantities of air from each of the two inactive sides of the principal-jet plane are essentially nil, or equal, or unequal;

h) a design such that the average momentum flux of the principal jets is approximately double or more than double the average momentum flux of the scavenging jets which issue from the scavenging-jet ports;

i) a design such that the average momentum flux of the central jets, if any, is less than the average momentum flux of the principal jets, but different from the average momentum flux of the scavenging jets;

j) said scavenging-jet ports and central-jet ports being oriented such that the scavenging jets and central jets are directed in a fully-opposed or partly-opposed or non-opposed juxtaposition relative to the principal-jet plane or the said plane above the principal-jet plane, as applicable;

k) dampers located at the port openings such that, when the dampers are operated, the size of the related port opening is reduced, thereby creating a smaller jet, or dampers are located upstream of the port openings such that, when the dampers are operated, the air pressure at the ports is reduced, thereby creating a smaller jet.

30. The primary air system as defined in claim 29 wherein: the said principal-jet plane is horizontal.

31. The primary air system as defined in claim 29 wherein: the said principal-jet plane is inclined such that the direction of the incline is in the direction of flow of the principal jets.

32. The primary air system as defined in claim 29 wherein: the said principal-jet plane is inclined such that the direction of the incline is at right angles to the direction of flow of the principal jets.

33. The primary air system as defined in claim 29 wherein: the said principal-jet plane is inclined such that the direction of the incline is parallel to the floor of the furnace.

34. The primary air system as defined in claim 29 wherein: the ports are arranged such that the said principal jets are all of similar size.

35. The primary air system as defined in claim 29 wherein: the ports are arranged such that the said first principal jets are similarly sized and the said second principal jets are similarly sized and are larger than the first principal jets.

36. The primary air system as defined in claim 29 wherein: the ports are arranged such that the said first principal jets are of different sizes and each said second principal jet is the same size as the first principal jet which it fully opposes or partly opposes.

37. The primary air system as defined in claim 29 wherein: the ports are arranged such that the said first principal jets are of different sizes and all the said second principal jets are larger than their respective fully-opposed or partly-opposed first principal jets.

38. The primary air system as defined in claim 29 wherein: the ports are arranged such that the said first principal jets are of different sizes and all the said second principal jets are larger than their respective fully-opposed or partly-opposed first principal jets by a common ratio.

39. The primary air system as defined in claim 29 wherein: the ports are arranged such that the said principal jets are arranged in a balanced partially interlaced pattern, comprising large and small principal air jets, each large jet being opposed by a small jet originating from the opposite wall and such that each large jet alternates with a small jet from the same wall and the large jets are all essentially the same size and the small jets are all essentially the same size and the pattern is symmetrical in the principal-jet plane with the flow from one active wall greater than the flow from the other active wall, or the pattern is asymmetrical in the principal-jet plane with the flow from one active wall essentially the same as the flow from the other active wall.

40. The primary air system as defined in claim 29 wherein: the ports are arranged such that the said principal jets are arranged in an unbalanced partially interlaced pattern, comprising large and small principal air jets, each large jet being opposed by a small jet originating from the opposite wall and such that each large jet alternates with a small jet from the same wall and all the large jets from the first wall are essentially the same size and are larger than the large jets from the second wall and all the small jets from the first wall are essentially the same size and are larger, or smaller, than all the small jets from the second wall and all the large jets from the second wall are essentially the same size and all the small jets from the second wall are essentially the same size and the pattern is symmetrical, or asymmetrical in the principal-jet plane.

41. The primary air system as defined in claim 29 wherein: large similarly-sized ports or groups of large similarly-sized ports or clusters of large similarly-sized ports are provided to create the said principal jets or said large principal air jets and such that smaller similarly-sized ports or groups of smaller similarly-sized ports, or clusters of smaller similarly-sized ports are provided to create the said small principal air jets and said scavenging jets and central jets, wherein the number of ports in the said groups and clusters of smaller ports is equal to or less than the number of ports in the said groups of large ports or clusters of large ports.

42. The primary air system as defined in claim 29 wherein: the said ports are all of similar size.

43. The primary air system as defined in claims 39 or 40 wherein:

a small jet is created by the air from a single port or a first group comprising a small number of similar-sized ports or a first cluster comprising a small number of similar-sized ports and a large jet is formed by a pair of ports of similar size to the first single port, or by a larger group than the first group where the ports are of similar size to the ports of the first group, or by a larger cluster of ports of similar size to the ports of the first cluster.

44. The primary air system as defined in claim 29 wherein: the air ports from which the principal jets and the scavenging jets issue are in horizontal groups each of whose centres is essentially on the sides of the said principal-jet plane.

45. The primary air system as defined in claim 29 wherein: the air ports from which the central jets issue are in horizontal groups each of whose centres is essentially on the sides of the said principal-jet plane or the said plane above the principal-jet plane.

46. The primary air system as defined in claim 29 wherein: the spacing between the principal-jet ports on each active wall is essentially the same.

47. The primary air system as defined in claim 29 wherein: the spacing between the principal-jet ports on each active wall is different.

48. The primary air system as defined in claim 29 wherein: one fan is provided to supply combustion air for the principal jets and the scavenging jets and the central jets.

49. The primary air system as defined in claim 29 wherein: separate fans are provided to supply combustion air for the principal jets, or for the scavenging jets, or for the central jets, or for the scavenging jets and the central jets.

* * * * *